US011493222B2

(12) United States Patent
Kabler et al.

(10) Patent No.: US 11,493,222 B2
(45) Date of Patent: Nov. 8, 2022

(54) ADVANCED MONITORING OF AN HVAC SYSTEM

(71) Applicant: Alarm.com Incorporated, Tysons, VA (US)

(72) Inventors: Ronald Byron Kabler, Roselle, IL (US); Murali Pasupuleti, Olathe, KS (US)

(73) Assignee: Alarm.com Incorporated, Tysons, VA (US)

( * ) Notice: Subject to any disclaimer, the term of this patent is extended or adjusted under 35 U.S.C. 154(b) by 232 days.

(21) Appl. No.: 16/883,659

(22) Filed: May 26, 2020

(65) Prior Publication Data

US 2020/0370777 A1 Nov. 26, 2020

Related U.S. Application Data

(60) Provisional application No. 62/851,861, filed on May 23, 2019.

(51) Int. Cl.
*F24F 11/49* (2018.01)
*F24F 11/52* (2018.01)
(Continued)

(52) U.S. Cl.
CPC ..... *F24F 11/49* (2018.01); *F24F 11/52* (2018.01); *F24F 11/58* (2018.01); *F24F 2140/60* (2018.01)

(58) Field of Classification Search
CPC .. F24F 11/49; F24F 11/52; F24F 11/58; F24F 2140/60; F24F 11/38
See application file for complete search history.

(56) References Cited

U.S. PATENT DOCUMENTS 7,913,180 B2 * 3/2011 Hoglund ..... F24F 11/30 236/94
8,560,127 B2 * 10/2013 Leen ..... G05D 23/1904 165/265

(Continued)

FOREIGN PATENT DOCUMENTS

| | | |
|---|---|---|
| JP | H03-271649 | 12/1991 |
| JP | 2003-169481 | 6/2003 |
| WO | WO 2014/188574 | 11/2014 |

OTHER PUBLICATIONS

PCT International Search Report and Written Opinion in International Application No. PCT/US2020/034577, dated Aug. 17, 2020, 20 pages.

(Continued)

*Primary Examiner* — Ramesh B Patel
(74) *Attorney, Agent, or Firm* — Fish & Richardson P.C.

(57) ABSTRACT

Methods, systems, and apparatus, including computer programs encoded on a computer storage medium, for advanced monitoring of an HVAC system. In some implementations, a voltage measurement across at least two interface terminals of a thermostat that controls an HVAC system of a property is obtained. The voltage measurements are analyzed. A likely power cycling activity of a component of the HVAC system is determined based on analyzing the voltage measurements. Whether the HVAC system is operating properly is determined based on the likely power cycling activity of the component of the HVAC system. Data indicating whether the HVAC system is operating properly is generated and outputted based on determining whether the HVAC system is operating properly.

20 Claims, 8 Drawing Sheets

(51) Int. Cl.
*F24F 140/60* (2018.01)
*F24F 11/58* (2018.01)

(56) References Cited

U.S. PATENT DOCUMENTS

| | | | | |
|---|---|---|---|---|
| 8,621,881 | B2 * | 1/2014 | Votaw | F24F 3/001 62/332 |
| 8,942,853 | B2 * | 1/2015 | Stefanski | G06F 3/0304 236/91 R |
| 9,298,197 | B2 * | 3/2016 | Matsuoka | F24F 11/30 |
| 9,568,902 | B2 * | 2/2017 | Dunn | G08B 13/19689 |
| 9,582,009 | B2 * | 2/2017 | Shahapurkar | G05D 23/1923 |
| 10,268,219 | B1 * | 4/2019 | Haynold | H02J 13/00 |
| 2014/0034284 | A1 * | 2/2014 | Butler | F25B 49/02 165/207 |
| 2014/0266755 | A1 | 9/2014 | Arensmeier et al. | |
| 2016/0299038 | A1 * | 10/2016 | Liu | F25D 29/00 |
| 2019/0056132 | A1 * | 2/2019 | Warren | F24F 11/62 |

OTHER PUBLICATIONS

EP Extended European Search Report in European Appln. No. 20809718.8, dated Jun. 3, 2022, 9 pages.

* cited by examiner

ADVANCED MONITORING OF AN HVAC SYSTEM

CROSS-REFERENCE TO RELATED APPLICATION

This application claims priority from U.S. Application No. 62/851,861, filed May 23, 2019, which is incorporated by reference.

TECHNICAL FIELD

This specification relates generally to HVAC systems.

BACKGROUND

Homes have HVAC systems that heat and cool the house. A resident of the house can adjust the temperature of the house using a thermostat.

SUMMARY

Existing technology relies on temperature change to detect abnormal HVAC operation. In common implementations, the thermostat commands the HVAC system and then monitors temperature over time to determine whether the system is operating properly. However, temperature change is affected by many things, such as outside temperature, open doors and/or windows, amount of sunlight on a given day, etc., and, thus, may provide a poor indication of whether the HVAC system is operating properly. Over time, a model can be developed, and enough data can be collected to detect abnormal operation of the HVAC system and possibly predict failure. However, developing such as a model can take a significant amount of time and can suffer from inaccuracies, at least initially.

In some implementations, a thermostat monitors the voltage across the power supply lines of a thermostat wiring interface and obtains a voltage waveform. The thermostat may be part of a security monitoring system of a monitored property. The monitored property may include an HVAC system. The monitored waveform may include various indications of the operations of the HVAC system. The thermostat may analyze the monitored waveform and compare it with a voltage waveform model. By comparing the monitored waveform with the waveform model, the thermostat may determine that an abnormal HVAC operation has occurred. In addition, by comparing the monitored waveform with the waveform model, the thermostat may identify the type of abnormal HVAC operation and/or the cause of the abnormal HVAC operation.

In some implementations, these abnormal HVAC operations include multiple tries required for the compressor to start, multiple tries for a blower to start, multiple tries for an inducer motor to start, multiple tries for an igniter to start, short cycling, excessive time for the compressor to start, excessive time for the blower to start, excessive time for the inducer motor to start, excessive time for the ignitor to ignite, failure of the compressor (e.g., failure to start), failure of the blower, failure of the inducer motor, failure of the igniter, premature stopping of the compressor, premature stopping of the blower, premature failure of the inducer motor, low coolant in refrigerant filled tubing, worn bearings in the compressor, or relay/switch/controller problems.

In some implementations, when the thermostat detects an abnormal HVAC operation, the thermostat sends an alert to a control unit of the security monitoring system. The control unit may attempt to verify the detected abnormal HVAC operation through use of one or more sensors. The control unit may send the alert or a modified alert to a monitoring server of the security monitoring server. The monitoring server may notify the owner of the monitored property that an abnormal HVAC operation has been detected and, in some implementations, that type of abnormal operation that occurred and/or the likely cause of the abnormal operation.

In one general aspect, a method includes: obtaining voltage measurements across at least two interface terminals of a thermostat that controls an HVAC system of a property; analyzing the voltage measurements; based on analyzing the voltage measurements, determining a likely power cycling activity of a component of the HVAC system; based on the likely power cycling activity of the component of the HVAC system, determining whether the HVAC system is operating properly; and based on determining whether the HVAC system is operating properly, generating and outputting data indicating whether the HVAC system is operating properly.

Implementations may include one or more of the following features. For example, in some implementations, determining the likely power cycling activity of the component of the HVAC system includes: identifying a voltage waveform from the voltage measurements; identifying one or more deviations in the voltage waveform from a waveform model; determining that the one or more deviations match one or more known voltage deviations, where the known voltage deviations correspond to different power cycling activities; and in response, determining the likely power cycling activity as the power cycling activity that corresponds to the one or more known voltage deviations.

In some implementations, the method includes obtaining the waveform model, where the waveform model corresponds to a signal generated by the thermostat or by the HVAC system.

In some implementations, the signal indicates that one or more components of the HVAC system should be turned on or have been turned on.

In some implementations, the signal indicates that one or more components of the HVAC system should be turned off or have been turned off.

In some implementations, the method includes obtaining the waveform model, where the waveform model corresponds to one or more of the HVAC system, components of the HVAC system, models of components of the HVAC system, the component of the HVAC system, or a model of the component of the HVAC system.

In some implementations, identifying the one or more deviations in the voltage waveform from the waveform model includes determining that the voltage waveform deviates one or more of a threshold amplitude or a threshold frequency from the waveform model.

In some implementations, the method includes obtaining the known voltage deviations, where the known voltage deviations correspond to one or more of power cycling events of components of the HVAC system, models of components of the HVAC system, the component of the HVAC system, a model of the component of the HVAC system, or electronic devices outside of the HVAC system.

In some implementations, determining that the one or more deviations match the one or more known voltage deviations includes determining that the one or more deviations are within one or more of a threshold amplitude or a threshold frequency from the one or more known voltage deviations.

In some implementations, determining the likely power cycling activity of the component of the HVAC system includes determining one or more of: the component of the HVAC system turned off; the component of the HVAC system turned on; the component of the HVAC system turned off and then turned on; or the component of the HVAC system turned on and then turned off.

In some implementations, obtaining the voltage measurements across at least two interface terminals of the thermostat includes obtaining, by the thermostat, the voltage measurements across the at least two interface terminals of the thermostat that are coupled to the component of the HVAC system; analyzing the voltage measurements includes analyzing, by the thermostat, the voltage measurements; determining the likely power cycling activity of the component of the HVAC system includes determining, by the thermostat, the likely power cycling activity of the component of the HVAC system; determining whether the HVAC system is operating properly includes determining, by the thermostat, whether the HVAC system is operating properly; and generating and outputting data indicating whether the HVAC system is operating properly includes generating and outputting, by the thermostat, data indicating whether the HVAC system is operating properly.

In some implementations, determining whether the HVAC system is operating properly includes: identifying an operation of the HVAC system corresponding to the voltage measurements, the operation indicating expected power cycling activities of components of the HVAC system and expected states of the components of the HVAC system; and determining that the HVAC system is operating properly if the likely power cycling activity of the component of the HVAC system is an expected power cycling activity of the expected power cycling activities, or determining that the HVAC system is operating improperly if the likely power cycling activity of the component of the HVAC system is not an expected power cycling activity of the power cycling activities.

In some implementations, the method includes: obtaining sensor data; and using the sensor data to independently verify one or more of that the component of the HVAC system experienced the likely power cycling activity, that a state of the component of the HVAC system matches an expected state of the component of the HVAC system based on the operation, a state of the component of the HVAC system does not match an expected state of the component of the HVAC system based on the operation, that power cycling activities experienced by the component of the HVAC system other than the likely power cycling activity match expected power cycling activities of the component of the HVAC system based on the operation, that power cycling activities experienced by the component of the HVAC system other than the likely power cycling activity do not match expected power cycling activities of the component of the HVAC system based on the operation, states of other components of the HVAC system match expected states of other components of the HVAC system based on the operation, states of other components of the HVAC system do not match expected states of other components of the HVAC system based on the operation, that power cycling activities of other components of the HVAC system match expected power cycling activities of other components of the HVAC system based on the operation, or that power cycling activities of other components of the HVAC system do not match expected power cycling activities of other components of the HVAC system based on the operation.

In some implementations, generating and outputting the data indicating whether the HVAC system is operating properly includes: generating information that includes one or more of an indication that the HVAC system is operating properly, an indication that the HVAC system is operating improperly, indications of unexpected power cycling activities, indications of components of the HVAC system that experienced unexpected power cycling activities, indications of unexpected states of components of the HVAC system, or indications of components of the HVAC system that have an unexpected state; and providing the information to a device.

In some implementations, analyzing the voltage measurements includes: applying one or more voltage thresholds to the voltage measurements; and determining the likely power cycling activity based on which of the one or more voltage thresholds are met.

In some implementations, the likely power cycling activity is a turn-on event of a component of the HVAC system or of an appliance of the property.

In some implementations, the likely power cycling activity is a turn-off event of a component of the HVAC system or of an appliance of the property.

In some implementations, determining the likely power cycling activity of the component of the HVAC system includes: identifying a state of the thermostat; based on the state, identifying one or more commands sent by the thermostat to the HVAC system, where each of the one or more commands is associated with a power cycling activity and a component of the HVAC system; determining one or more time periods corresponding to the one or more commands; determining that the likely power cycling activity occurs during a time period of the one or more time periods; and associating the likely power cycling activity with the component of the HVAC system that corresponds to the time period.

The details of one or more embodiments of the invention are set forth in the accompanying drawings and the description below. Other features and advantages of the invention will become apparent from the description, the drawings, and the claims.

BRIEF DESCRIPTION OF THE DRAWINGS

Like reference numbers and designations in the various drawings indicate like elements.

DETAILED DESCRIPTION

Many residents equip their homes with security monitoring systems that include one or more sensors and controls for monitoring the resident's property. For example, the monitoring system may include cameras that capture activity within a room or at an access point (e.g., at a door), motion detectors that sense movement within an area of the property, door and window sensors (e.g., to detect whether a door or window is open and/or broken), sensors on utilities (e.g., to detect water usage), or environmental controls (e.g., thermostat settings). In some cases, the monitoring system may include controlled-access entry points that require user-authentication for passage, for example, a door equipped with a keypad requiring a user-specific code for entry. Such monitoring systems are not limited to homes and may be installed in a variety of properties, including commercial buildings as well as other residential buildings (e.g., apartments, condos, etc.).

Figure 1:
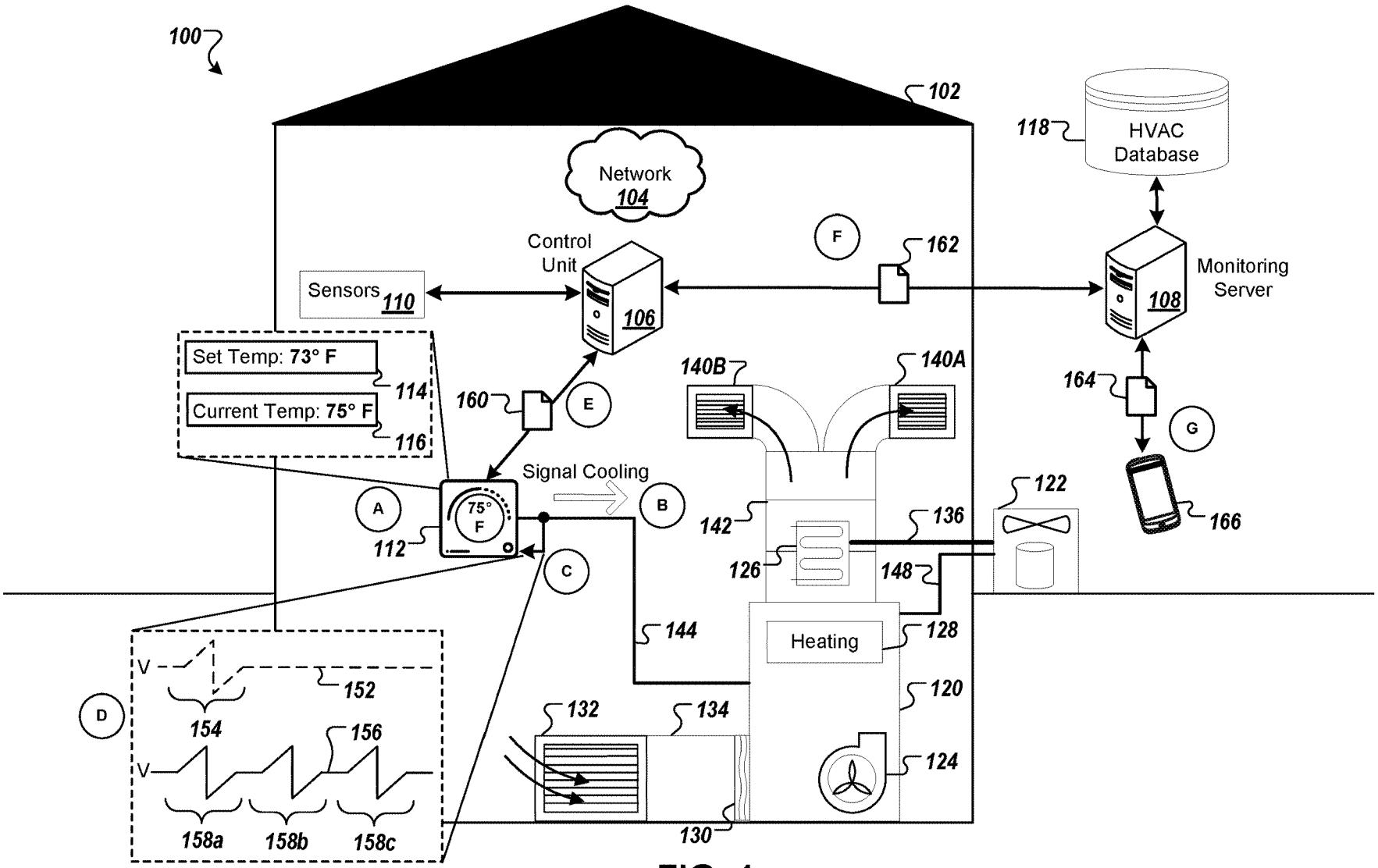
FIG. 1 is a diagram that illustrates an example system for monitoring an HVAC system using a security monitoring system.

FIG. 1 shows an example security monitoring system 100 for a monitored property 102. The security monitoring system 100 includes a control unit 106, a monitoring server 108, an HVAC database 118, sensors 110, and a thermostat 112. The security monitoring system 100 is able to able to monitor the operation of an HVAC system 120 in order to determine if any abnormal operations have occurred. The security monitoring system 100 may leverage existing components of a residential security system in order to monitor the operation of an HVAC system 120.

Various parts of the security monitoring system 100 may be able to communicate over a network 104. The network 104 may be wired or wireless or a combination of both and can include the Internet.

The control unit 106 may include one or more computing devices. The control unit 106 may communicate with sensors 110 and thermostat 112 through a wired or wireless connection. In implementations where the control unit 106 communicates with sensors 110 and thermostat 112 through a wireless connection, the communication may take place over network 104. The control unit 106 may communicate with the monitoring server 108 over network 104.

The monitoring server 108 may include one or more computing devices. The monitoring server 108 may further communicate with an HVAC database 118. In some implementations, the monitoring server 108 communicates with the HVAC database 118 wirelessly over network 104. In some implementations, the monitoring server 108 communicates with the HVAC database 118 over a wired connection. In some implementations, the monitoring server 108 includes the HVAC database. The monitoring server 108 may further communicate with a client device 166 over a wireless connection. In some implementations, monitoring server 108 communicates with the client device 166 over network 104.

The monitored property 102 includes the HVAC system 120. The HVAC system 120 includes an air conditioning compressor 122, a return air duct 132, air duct 134, an air filter 130, a blower 124, a heating element 128, an evaporator coil 126, air handling unit 142, refrigerant filled tubing 136, and supply air grills 140A and 140B. The HVAC system 120 may also include an inducer motor and an igniter. The HVAC system 120 may communicate with the thermostat 112 over a communications link 144. In some implementations, the communications link 144 is a wireless connection (e.g., where the thermostat 112 is a wireless thermostat) over network 104. Communications link 144 may be a wired connection. In some implementations, the communications link 144 includes a heat control wire, a cooling control wire, and a power wire. In other implementations, the communication link 144 includes a heat control wire, a cooling control wire, a power wire, and a common wire.

Figure 2A:
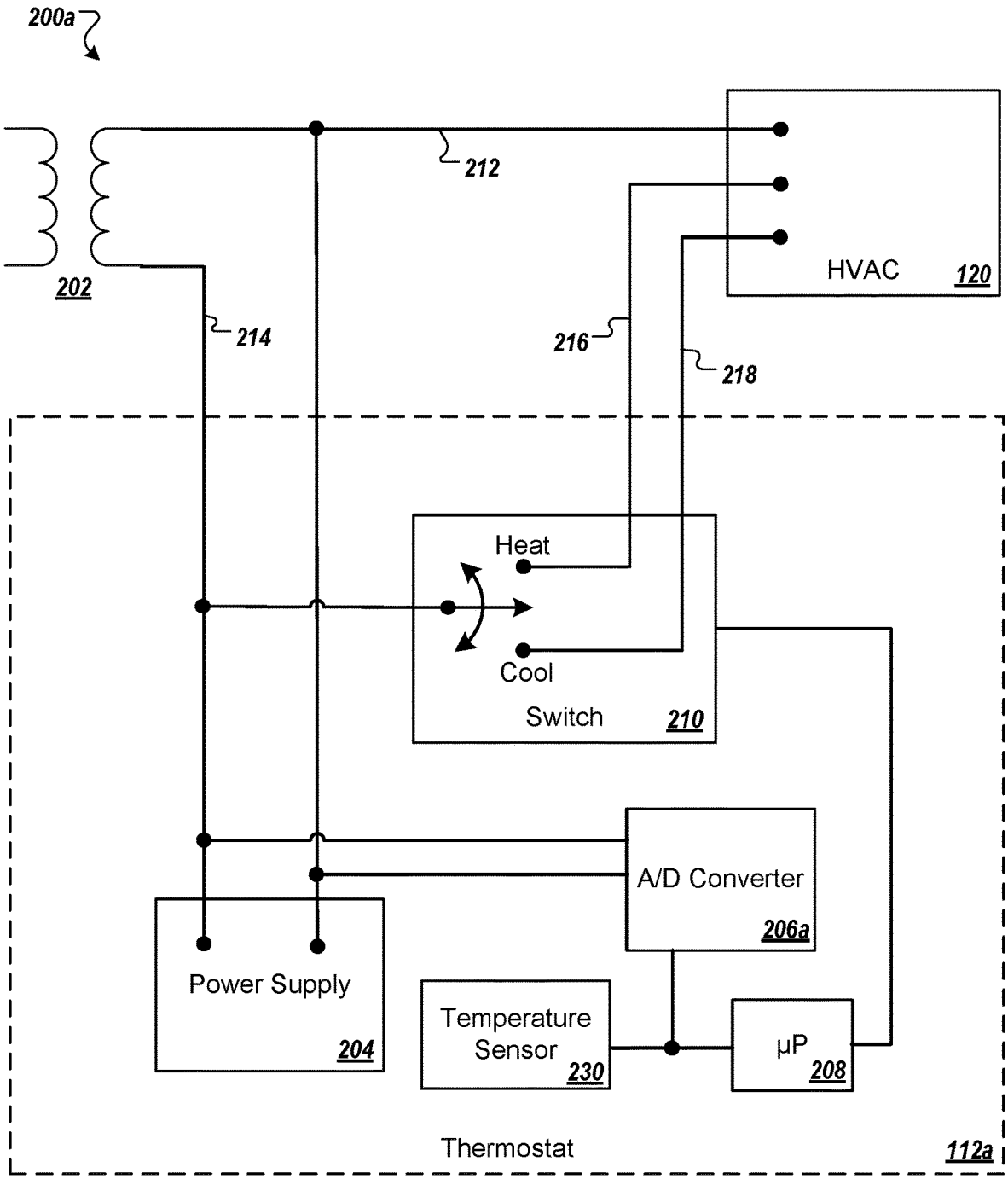
FIGS. 2A through 2B are example circuit diagrams.
Figure 2B:
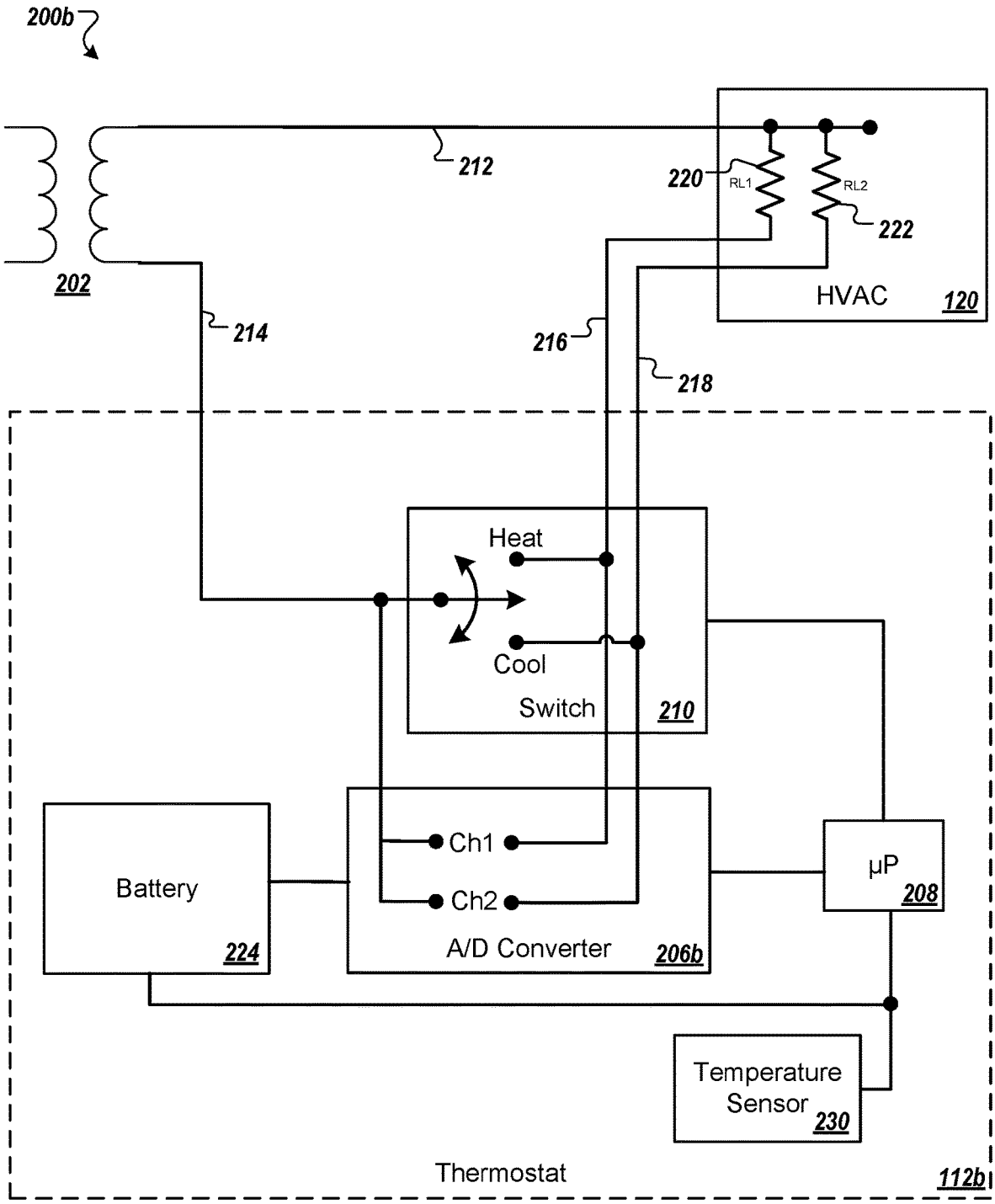

The thermostat 112 includes a thermometer to detect a current temperature 116 of the monitored property 102. The thermostat 112 may further include a microprocessor (e.g., microprocessor 208 as shown in FIGS. 2A-2B). The thermostat 112 may further include a dedicated processor to be used for monitoring the HVAC system. The thermostat 112 may be a programmable thermostat or a learning thermostat (e.g., a smart thermostat). In some implementations, thermostat 112 is a mechanical thermostat. The thermostat 112 communicates with the control unit 106 and the HVAC system 120 over a communication link 144. In some implementations, the thermostat 112 communicates with the control unit 106 wirelessly over network 104. In some implementations, the thermostat 112 communicates with the control unit 106 over a wired connection.

The thermostat 112 may also include a screen. Through the screen, as shown, the thermostat 112 displays a current temperature 116 of the monitored property 102. In some implementations, the thermostat 112 may alternatively display a set temperature 114 of the monitored property 102. In some implementations, the thermostat 112 may alternatively switch between displaying the current temperature 116 and the set temperature 114.

The sensors 110 may include, for example, one or more visible-light cameras, infrared-light cameras (IR cameras), magnetic sensors (e.g., that are installed on one or more doors and/or windows), and/or additional thermometers. The sensors 110 communicate with the control unit 106. One or more sensors of the sensors 110 may communicate with the control unit 106 wirelessly over network 104. One or more sensors of the sensors 110 may communicate with the control unit 106 over a wired connection.

The security monitoring system 100 may send notifications to and/or receive instructions from a client device 166. The client device 166 can be, for example, a desktop computer, a laptop computer, a tablet computer, a wearable computer, a cellular phone, a smart phone, a music player, an e-book reader, a navigation system, a security panel, or any other appropriate computing device. The client device 166 may communicate with the monitoring server 108 wirelessly. In some implementations, the client device 166 communicates with the monitoring server 108 over the network 104.

The disclosed system allows for quickly identifying abnormal operation of an HVAC system through monitoring of the power supply lines available on a standard thermostat wiring interface. By monitoring the voltage on the power supply lines soon after an instruction is provided to the HVAC system and comparing the monitored voltage with an existing waveform model, the disclosed system can swiftly detect abnormal HVAC operations without the need for a lengthy collection period.

The disclosed system has the benefit of increasing the accuracy of identifying abnormal HVAC operation. The voltage on the power supply lines following a received instruction (e.g., from a thermostat) indicates, with a high degree of accuracy, various operations of the HVAC system. These indications may not be affected by other variables that may affect other systems. For example, other systems may rely on monitoring temperature over time to determine if the HVAC system is operating properly and, thus, suffer from inaccuracies due to factors such as the outside temperature, open doors and/or windows, the amount of sunlight on a given day, etc. In contrast, the disclosed system does not rely on monitoring temperature to determine if the HVAC system is operating properly and its accuracy is accordingly unaffected by external contributions to a property's temperature.

The disclosed system has the additional benefit of working with standard thermostat wiring interface. As such, the time, expertise, and costs associated with installing and maintaining such a system are reduced.

FIG. 1 also illustrates a flow of events, shown as stages (A) to (G), with each representing a step in an example process. Stages (A) to (G) may occur in the illustrated sequence, or in a sequence that is different from the illustrated sequence. For example, some of the stages may occur concurrently.

As shown in FIG. 1, at stage (A), the thermostat 112 detects that the current temperature 116 within the property 102 is above a set temperature 114. The set temperature 114 may be preset. The set temperature 114 may be set by an occupant of the property 102. The set temperature 114 may be determined by the thermostat 112 itself, for example, in implementations where the thermostat 112 is a smart thermostat. The set temperature 114 may be variable based on one or more factors, such as the time of day, the time of year, the outside temperature, whether the house is determined to be vacant (e.g., through one or more sensors of sensors 110 of the security monitoring system 100).

In other implementations, the thermostat 112 detects that the current temperature 116 is a threshold level above the set temperature 114. In these implementations, the thermostat 112 may withhold performing further action until the threshold level is met (e.g., may wait to perform the signaling step of stage (B) until the threshold level is met). For example, if the threshold level is set to 2° F. and the set temperature 114 is 73° F., the thermostat 112 may withhold performing additional action until it detects that the current temperature 116 is 75° F.

At stage (B), in response to detecting that the current temperature 116 is above the set temperature 114 (or, in some implementations, that the current temperature 116 is a threshold level above the set temperature 114), the thermostat 112 provides a signal to the HVAC system 120 over the communication link 144. Here, this signal is a signal to start cooling. For example, the thermostat 112 moves the cooling signal high until the detected temperature in the property 102 drops to or below the set temperature 114. As described herein, a signal to start cooling may refer to moving the cooling signal high.

In some implementations, a different signal is provided by the thermostat 112 to the HVAC system 120. These other signals may include moving the cooling signal low, moving the heat signal high, or moving the heat signal low. These other signals may include a signal to stop cooling, a signal to start heat, and a signal to stop heat. As described herein, a signal to stop cooling may refer to moving the cooling signal low. As described herein, a signal to start heat may refer to moving the heat signal high. As described herein, a signal to stop heat may refer to moving the heat signal low.

In some implementations, only particular signals can be provided by the thermostat 112 to the HVAC system 120 due to a state of the HVAC system 120. For example, only a stop cooling signal may be provided when the HVAC system 120 is in a cooling state, only a stop heat signal may be provided when the HVAC system 120 is in a heat state, and a start cooling signal or a start heat signal may be provided when the HVAC system 120 is in an off or suspended state. This may mean that only moving the cooling signal low is possible when the cooling signal is high, only moving the heat signal low is possible when the heat signal is high, and only moving the heat signal or the cooling signal to high is possible when both the heat signal and the cooling signal are low.

At stage (C), after providing the cooling signal to the HVAC system 120, the thermostat 112 monitors the alternating current (AC) voltage across part of the communication link 144, samples the AC voltage, and stores the sampled waveform. The thermostat 112 may convert the resulting sampled waveform to a parameterized waveform (e.g., a waveform of the changes of the RMS voltage of the sampled waveform). Here, the thermostat 112 may monitor the voltage across the power supply lines (e.g., the power wire and the common wire) of the communication link 144 (e.g., thermostat wiring interface). The amount of time that the thermostat 112 monitors the voltage across the power supply lines of the communication link 144 may be a preset period of time (e.g., 0.1 s, 0.2 s, 0.5 s, 1 s, 2 s, etc.). In some implementations, the preset period of time for monitoring the voltage across the power supply lines is dependent on whether the thermostat 112 provides the HVAC system 120 a cooling signal or a heat signal, and/or whether the signal is a signal to start or a signal to stop.

In some implementations, the thermostat 112 starts monitoring the voltage across the power supply lines of the communication link 144 before providing the signal to the HVAC system 120. In other implementations, the thermostat 112 starts monitoring the voltage across the power supply lines of the communication link 144 immediately after the providing the signal to the HVAC system 120. In other implementations, the thermostat 112 starts monitoring the voltage across the power supply lines of the communication link 144 after a predetermined delay after sending the signal to the HVAC system 120. The monitored voltage can be in the form of a monitored waveform 156.

In storing the monitored waveform 156, the thermostat 112 may convert the monitored waveform 156 into cycle values and store the resulting cycle values.

In some implementations, the thermostat 112 also or alternatively monitors the alternating current (AC) voltage across the power supply lines of the communication link 144. In these limitations, the thermostat 112 may sample the AC voltage and store the resulting sampled waveform.

In some implementations, at stage (C), the thermostat 112 sends a request to control unit 106 for a waveform model 152 with which to compare the monitored waveform 156. The waveform model requested may depend on a signal the thermostat 112 provided to the HVAC system 120 (e.g., a signal to start cooling). The waveform model requested may further, or alternatively, depend on the whether the communication link 144 contains a common wire that is being monitored by the thermostat 112. The waveform model requested may further or alternatively depend on the HVAC system 120 and/or the components of the HVAC system 120 (e.g., the type or model of the compressor 122, the blower 124, the heating element 128, the evaporator coil 126, etc.). In these implementations, the control unit 106 may pass the request to the monitoring server 108 or send a modified request to the monitoring server 108 for the waveform model. The monitoring server 108 may then access and retrieve the requested waveform model from the HVAC database 118. The monitoring server 108 may send the waveform model to the control unit 106 which can provide it to the thermostat 112.

In some implementations, at stage (C), the thermostat 112 sends a request to control unit 106 for multiple waveform models (e.g., including waveform model 152). For example, the thermostat 112 may request a waveform model for both a sample waveform and a parameterized waveform (e.g., a waveform of the changes of the RMS voltage of the sampled waveform). For example, the thermostat 112 may request all waveform models associated with the HVAC system 120 and the communications link 144 (e.g., those waveforms associated with a common wire power supply line, with a particular blower, with a particular compressor, with a particular heating unit, etc.).

In other implementations, the thermostat 112 already contains waveform model 152 and other waveform models.

In these implementations, one or more waveform models may have already been retrieved from the HVAC database 118 and provided to the thermostat 112, where they are stored. In these implementations, the one or more waveform models may have been pre-loaded into the thermostat 112. The waveform models may include a waveform model for each of the possible signals. The one or more waveform models may include two waveform models for each of the possible signals such that, for example, there is a sample waveform and a parameterized waveform (e.g., a waveform of the changes of the RMS voltage of the sampled waveform) for each of the possible signals. The one or more waveform models may be retrieved from the HVAC database 118 and stored in the thermostat 112 when the thermostat 112 is installed, when the thermostat 112 is connected to the HVAC system 120 through communication link 144, or when instructed to do so by a client (e.g., an owner of the monitored property 102) through client device 166.

In some implementations, at stage (C), the thermostat 112 also sends the monitored waveform 156 to the control unit 106. In these implementations, the thermostat 112 may also send additional information associated with the monitored waveform 156 (e.g., the type of signal provided by the thermostat 112 to the HVAC system 120, whether the waveform is a sampled waveform or a parameterized waveform, etc.). In these implementations, the control unit 106 may send the monitored waveform 156 (and, in some implementations, the additional information associated with the waveform) to the monitoring server 108. The monitoring server 108 may store the monitored waveform 156 (and, in some implementations, the additional information associated with the waveform) in, for example, the HVAC database 118. The monitoring server 108 may also analyze the monitored waveform 156. The analysis of the monitored waveform 156 may be used by the monitoring server 108 to update or assist in updating one or more waveform models stored in the HVAC database 118 (e.g., the waveform models for the HVAC system 120).

In some implementations, the thermostat 112 receives updated waveform models retrieved from HVAC database 118. The thermostat 112 may receive these updated waveform models on a periodic bases or may check for updates periodically. Alternatively, the thermostat 112 may receive these updated waveform models when they come available (e.g., when created by the monitoring server 108).

At stage (D), the thermostat 112 accesses the waveform model 152 and compares it with the monitored waveform 156 in order to identify abnormal operations by the HVAC system 120. The waveform model 152 accessed is a model for a parameterized waveform for the signal provided by the thermostat 112 to the HVAC system 120 in stage (B). Here, the signal provided was a signal to start cooling. The waveform model 152 has a single event 154 in the voltage at a first time. The event 154 may be associated with a known HVAC operation (e.g., attempt to start the compressor 122, attempt to start the blower 124, an attempt to start an inducer motor, an attempt to start an igniter, start of the compressor 122, start of the blower 124, start of the inducer motor, start of the igniter, etc.). Here, the event 154 is associated with an attempt to start the compressor 122.

In comparing the waveform model 152 with the monitored waveform 156, the thermostat 112 may analyze the monitored waveform 156. An analysis may include determining an amplitude and phase of the monitored waveform (e.g., at 60 Hz), amplitude and phase of harmonics, and/or abrupt/unusual departures in the waveform. Here, an analysis of the monitored waveform 156 reveals a first event 158*a* at the first time, a second event 158*b* at a second time, and a third event 158*c* at a third time.

In comparing the waveform model 152 with the monitored waveform 156, the thermostat 112 may determine that the event 158*a* occurred at substantially the same time as the expected event 154 in the waveform model 152 and had substantially the same shape and/or size. The thermostat 112 may determine that the events 158*b* and 158*c* are unexpected as there are no events or substantially similar events in the waveform model 152 at or near the time at which the events 158*b* and 158*c* occurred. As such, the thermostat 112 may consider the events 158*b* and 158*c* deviations. Based on these determinations, the thermostat 112 may determine that an abnormal HVAC operation occurred.

In attempting to identify the abnormal operation, the thermostat 112 may compare the events 158*b* and 158*c* with the event 154 or with other known events for normal HVAC operations and/or deviations for abnormal HVAC operations (e.g., multiple tries required for the compressor 122 to start, multiple tries for the blower 124 to start, multiple tries for the inducer motor to start, multiple tries for the igniter to start, short cycling, excessive time for the compressor 122 to start, excessive time for the blower 124 to start, excessive time for the inducer motor to start, excessive time for the ignitor to ignite, failure of the compressor 122, failure of the blower 124, failure of the inducer motor, failure of the igniter, premature stopping of the compressor 122, premature stopping of the blower 124, premature failure of the inducer motor, low coolant in the refrigerant filled tubing 136, worn bearings in the compressor 122, relay/switch/controller problems, etc.). Here, the thermostat 112 determines that events 158*b* and 158*c* are substantially similar to the event 154. As such, the thermostat 112 identifies the abnormal operation by the HVAC system 120 to be two additional attempts to start the compressor 122.

The size or shape of a deviation may indicate the source of the deviation from within the HVAC system 120. For example, components of the HVAC system 120 requiring greater power may produce a larger event on the monitored voltage and, thus, a larger deviation when an error occurs when compared with components of the HVAC system 120 requiring less power. In some implementations, the thermostat 112 identifies the cause of the abnormal HVAC operation based on the size and/or shape of the deviation.

When comparing the waveform model (e.g., waveform model 152) with a monitored waveform (e.g., monitored waveform 156), the thermostat 112 may determine that an abnormal HVAC operation has occurred if an expected event (e.g., event 154) is not found in the monitored waveform. Depending on the event that is missing, the thermostat 112 may be able to identify the cause or type of abnormal HVAC operation. As an example, the thermostat 112 may provide a signal to the HVAC system 120 to turn the cooling off and subsequently obtain a monitored waveform that is missing an event. The missing event may correlate with the stopping of the compressor 122 and may have been expected at a particular timing offset from when the signal was provided. In this example, based on the monitored waveform, the thermostat 112 may determine that an abnormal HVAC operation occurred. In addition, the thermostat 112 may determine that the monitored waveform suggests that the compressor 122 shut down prematurely.

In other implementations, at stage (D), the attempt to identify the abnormal operation is performed by the monitoring server 108. In these implementations, the thermostat 112 sends the results of the comparison to the control unit 106 along with, in some implementations, the monitored waveform 156. The control unit 106 then sends the results of the comparison along with, in some implementations, the monitored waveform 156 to the monitoring server 108. The monitoring server 108 may attempt to identify the abnormal operation in accordance with the method described above. In attempting to identify the abnormal operation, the monitoring server 108 may access waveform models and/or known deviations stored in the HVAC database 118.

In other implementations, at stage (D), the monitoring server 108 performs the comparison of the waveform model 152 with the monitored waveform 156. In these implementations, the monitored waveform 156 is sent to the control unit 106. In these implementations, the control unit 106 sends the monitored waveform 156 to the monitoring server 108 which retrieves the waveform model 152 (e.g., from the HVAC database 118) and compares it with the waveform model 152. In these implementations, the thermostat 112 may provide the control unit 106 additional information associated with the monitored waveform 156 (e.g., the type of signal provided by the thermostat 112 to the HVAC system 120, whether the waveform is a sampled waveform or a parameterized waveform, etc.). The control unit 106 may provide this additional information to the monitoring server 108. In these implementations, the monitoring server 108 performs the comparison in accordance with the methods described above. In these implementations, the monitoring server 108 may identify the abnormal operations in accordance with the methods described above.

In other implementations, at stage (D), the control unit 106 performs the comparison of the waveform model 152 with the monitored waveform 156 in accordance with the methods described above. In these implementations, the control unit 106 may identify the abnormal operations in accordance with the methods described above.

In other implementations, at stage (D), the control unit 106 identifies the abnormal operations in accordance with the methods described above. In these implementations, the thermostat 112 may perform the comparison in accordance with the methods described above. In these implementations, the monitoring server 108 may perform the comparison in accordance with the methods described above.

In other implementations, at stage (D), instead of comparing the monitored waveform 156 with a waveform model 152, the monitoring server 108 provides the monitored waveform 156 to one or more machine learning models or networks. These one or more machine learning models or networks may include may include one or more artificial neural networks, one or more maximum entropy classifiers, one or more decision tress, one or more support vector machines, one or more regression models, and/or one or more clustering models. These one or more machine learning models or networks may implement unsupervised machine learning methods such as clustering and density based estimation. These one or more machine learning models or networks may be trained with monitored waveforms of a properly functioning HVAC system. These one or more machine learning models or networks may be trained with expected waveforms of a properly functioning HVAC system. These one or more machine learning models or networks may be trained with monitored waveforms of the HVAC system 120 when the HVAC system 120 was determined to be functioning properly. The output of these one or more machine learning models or networks may indicate the likely power cycling events that have occurred in response to the cooling signal sent by the thermostat 112. The output of these one or more machine learning models or networks may indicate the components of the HVAC system 120 associated with the detected power cycling events. The monitoring server 108 may analyze the output of these one or more machine learning models or networks to determine the likely power cycling events and/or associated components of the HVAC system 120.

In other implementations, at stage (D), instead of comparing the monitored waveform 156 with a waveform model 152, the monitoring server 108, the control unit 106, or the thermostat 112 analyzes the monitored waveform 156. An analysis of the monitored waveform 156 may include determining and analyzing the frequency of the monitored waveform 156, determining and analyzing the amplitude of any peaks within the monitored waveform 156, and/or calculating and analyzing the time offset between the thermostat-issued cooling signal and a change in the monitored waveform 156's amplitude. An analysis of the frequency or the amplitude of any peaks of the monitored waveform may include applying one or more thresholds and/or one or more ranges. There may be one or more frequency thresholds. For example, there may be a frequency threshold such that if a frequency of the monitored waveform 156 exceeds the frequency threshold, a problem has likely occurred or a particular problem has likely occurred (e.g., the blower 124 unexpectedly restarted). There may be one or more frequency ranges. For example, particular frequencies or ranges of frequencies may be associated with one or more particular power cycling events (e.g., starting the compressor 122, starting the blower 124, etc.). There may be one or more amplitude thresholds. For example, there may be an amplitude threshold such that if one or more amplitudes of the peaks of the monitored waveform 156 exceeds the amplitude threshold, a problem has likely occurred or a particular problem has likely occurred (e.g., the blower 124 unexpectedly restarted). There may be one or more amplitude ranges. For example, particular amplitudes or ranges of amplitudes may be associated with one or more particular power cycling events (e.g., starting the compressor 122, starting the blower 124, etc.). Similarly, a power cycling event may be identified based on a combination of the detected frequency and amplitude, e.g. by using a combination of amplitude and frequency thresholds or by using a combination of amplitude and frequency ranges.

At stage (E), the thermostat 112 sends a signal containing a data packet 160 to the control unit 106 and the control unit 106 analyzes the data packet 160. The data packet 160 contains information indicating that abnormal HVAC operations have been detected. The data packet 160 may contain additional information indicating, for example, the type of abnormal operations detected, the number of abnormal operations, the signal provided by the thermostat 112 to the HVAC system 120 (here, a signal to start cooling), etc.

At stage (E), the control unit 106 analyzes the data packet 160. Analyzing the data packet 160 may include extracting the contents from the data packet 160 and parsing through the contents of the data packet 160.

In some implementations, at stage (E), the control unit 106 requests information from sensors 110. The control unit 106 may use this information to verify that an abnormal HVAC operation has occurred, may use this information to rebut the determination that an abnormal HVAC operation has occurred, or may use this information to identify the cause (or narrow down the cause) of the abnormal HVAC operation. For example, the control unit 106 may receive information from an IR camera of the sensors 110 indicating that the air temperature exiting the air grill 140*a* and/or air grill 140*b* is a certain temperature. In this example, the control unit 106 may determine that the air temperature exiting the air grill 140*a* and/or air grill 140*b* is higher than expected after the HVAC system 120 receives a cooling signal. As such, the control unit 106 may verify that the HVAC system 120 is operating abnormally.

As another example, information from an IR camera of sensors 110 may indicate that the compressor 122 is operating (e.g., by detecting a particular temperature of the compressor 122). This information may be provided to and used by the control unit 106 (potentially along with additional information) to rebut the determination that an abnormal HVAC operation has occurred. Alternatively, this information may be used by the control unit 106 to determine that the compressor 122 is not the cause of the abnormal HVAC operation. Due to the elimination of a potential cause of the abnormal HVAC operation and due to the abnormal HVAC operation being related to cooling, the control unit 106 may narrow down the potential causes to the blower 124, the evaporator coil 126, or a lack of refrigerant in the refrigerant filled tubing 136.

As another example, information from one or more window and/or door magnetic sensors of sensors 110 may indicate that one or more windows and/or doors are open. This information may be provided to and used by the control unit 106 (potentially along with additional information) to determine that the abnormal HVAC operation may be due to excess stress on the HVAC system 120 from having one or more windows and/or doors open. Similarly, visible-light cameras may be used by the control unit 106 to determine if any doors and/or windows are open. Similarly, an IR camera may be used by the control unit 106 to determine parts of the monitored property 102 that are abnormally hot or cold, which may indicate an open door and/or window.

In some implementations, at stage (E), based on the information received from sensors 110 and/or based on the information contained within the data packet 160, the control unit 106 may assign a confidence score to the determination that an abnormal HVAC operation occurred (e.g., the determination by the thermostat 112).

At stage (F), the control unit 106 sends a signal containing a data packet 162 to the monitoring server 108, the monitoring server 108 analyzes the data packet 162, and the monitoring server 108 creates a notification based on the analysis. The data packet 162 may contain the information found within the data packet 160 (e.g., the type of abnormal operations detected, the number of abnormal operations, the signal provided by the thermostat 112 to the HVAC system 120, etc.). Alternatively, the data packet 162 may contain information found within the data packet 160 as modified by the control unit 106. The data packet 162 may also contain indications of determination made by the control unit 106 (e.g., potential elements of the HVAC system 120 that may be responsible for the abnormal HVAC operation, a verification of the abnormal HVAC operation, a rebuttal of the abnormal HVAC operation, etc.).

In some implementations, if the control unit 106 determines that the additional information from sensors 110 is sufficient to rebut the determined abnormal HVAC operation, the control unit 106 will not send a signal containing the data packet 162 to the monitoring server 108.

In some implementations, if the control unit 106 determines that the additional information from sensors 110 is sufficient to rebut the determined abnormal HVAC operation, the control unit 106 will send a signal containing the data packet 162 to the monitoring server 108. In these implementations, the data packet 162 may contain only an indication that an abnormal HVAC operation was detected and/or an indication that the detection of the abnormal HVAC operation was rebutted.

At stage (F), the monitoring server 108 analyzes the data packet 162. Analyzing the data packet 162 may include extracting the contents from the data packet 162 and parsing through the contents of the data packet 162.

At stage (F), the monitoring server 108, based on the analysis of the data packet 162, creates a notification 164. This notification 164 may include, for example, an indication that an abnormal HVAC operation was detected, an indication of the type of abnormal HVAC operation that was detected, a time at which the abnormal HVAC operation was detected, the operation that the HVAC system 120 was attempting to perform when the abnormal HVAC operation was detected (here, a cooling operation), an indication of the one or more elements of the HVAC system 120 that are responsible for the abnormal HVAC operation (e.g., one or more elements of the HVAC system 120 that have failed or are in the process of failing), an indication of the one or more elements of the HVAC system 120 that may be responsible for the abnormal HVAC operation, an indication that the abnormal HVAC operation was verified (e.g., by the control unit 106), an indication that the abnormal HVAC operation was rebutted (e.g., by the control unit 106), and/or a confidence score that the abnormal HVAC operation occurred (e.g., as determined by the control unit 106).

At stage (G), the monitoring server 108 sends the notification 164 to the client device 166. The notification 164 may be provided to the client device 166 over network 104, over a cellular network, or over some other network. The notification 164 may be provided through a smartphone app on the client device 166. The notification 164 may be in the form of a text message or a smartphone notification. The notification 164 may be in the form of an email.

In some implementations, at stage (G), the monitoring server 108 may also send a notification to a technician device. This notification may be the same as notification 164 or may be a modified version of notification 164. In these implementations, the monitoring server 108 may only send a notification to a technician when certain requirements are met. For example, it may be required that a client has indicated through their client device 166 that they wish for such notifications (or this particular notification) to be sent to a technician (e.g., client has previously indicated such in settings of a security monitoring app or program installed on their client device 166; the receipt of the notification 164 at the client device 166 triggers a request to the client asking if they wish for the security monitoring system 100 to contact a technician about this issue, and the client responds to the request through the client device 166 in the affirmative; or the notification 164 includes a request to the client asking if they wish for the security monitoring system 100 to contact a technician about this issue, and the client responds to the request through the client device 166 in the affirmative).

FIGS. 2A through 2B are example circuit diagrams permitting the thermostat 112 to monitor voltage on the power supply lines of the thermostat wiring interface. FIGS. 2A and 2B show two different embodiments of the thermostat 112. FIG. 2A depicts a first embodiment of the thermostat 112 as thermostat 112*a*. FIG. 2B depicts a second embodiment of the thermostat 112 as thermostat 112*b*.

As shown in FIG. 2A, the circuit diagram 200*a* includes the thermostat 112*a*, the HVAC system 120, a transformer 202, a common wire 212, a power wire 214, a heat control wire 216, and a cooling control wire 218. The circuit diagram 200*a* permits the thermostat 112*a* to monitor the voltage across the transformer 202 when the thermostat 112*a* has access to both the common wire 212 and the power wire 214. The thermostat 112*a* is able to monitor the voltage across the transformer 202 by taking the difference in voltage across power supply lines (e.g., the common wire 212 and the power wire 214). The transformer 202 may be a step-down transformer (e.g., a 24 VAC transformer).

The thermostat 112*a* includes a power supply 204, an analog-to-digital converter (ADC) 206*a*, a microprocessor 208, a switch 210, and a temperature sensor 230. As shown the switch 210 is a single pole double throw (SPDT) switch or relay with an On-Off-On configuration, though other switches/relays and configurations are possible. Here, the switch 210 is currently in the off position. In the off position, no current (or substantially no current) is provided to heat control wire 216 nor the cooling control wire 218. When the switch 210 is moved to the first on position (heat position), current from the power wire 214 is provided to the heat control wire 216 which signals the HVAC system 120 to start the heat operation. In the heat position, no current (or substantially no current) is provided to the cooling control wire 218. When the switch 210 is moved to the second on position (cool position), current from the power wire 214 is provided to the cooling control wire 218 which signals the HVAC system 120 to start the cooling operation. The temperature sensor 230 may be a bimetallic mechanical or electric sensor, an electronic thermistor, a resistive temperature detector, a thermocouple, or a semi-conductor sensor. The output of the temperature sensor 230 may be provided to the microprocessor 208.

The ADC 206*a* receives the power wire 214 voltage as a first input and the common wire 212 voltage as a second input. The ADC 206*a* may take a voltage differential between the two inputs and, thus, obtain the voltage across the transformer 202. The ADC 206*a* proceeds to sample the obtained transformer 202 voltage in order to produce a digital signal. This digital signal is sent to the microprocessor 208 from the ADC 206*a*.

The microprocessor 208 analyzes the digital signal. In analyzing the digital signal, the microprocessor 208 may access a waveform model (e.g., accessed from storage on the thermostat 112*a* or received from the control unit 106 as shown in FIG. 1) and compare the digital signal with the accessed waveform. In comparing the digital signal with the accessed waveform, the microprocessor 208 may identify deviations in the digital signal from the waveform model. In some implementations, these deviations are further analyzed by the microprocessor 208.

As shown in FIG. 2B, the circuit diagram 200B includes the thermostat 112*b*, the HVAC system 120, a transformer 202, a common wire 212, a power wire 214, a heat control wire 216, and a cooling control wire 218. The circuit diagram 200B permits the thermostat 112*b* to monitor the voltage across the transformer 202 when the thermostat 112*b* does not have access to the common wire 212. The transformer 202 may be a step-down transformer (e.g., a 24 VAC transformer). Here, the heat control wire 216 is connected in series with a first resistance 220 (e.g., a first load). The other end of the resistance 220 is connected to the common wire 212. The cooling control wire 218 is connected to a second resistance 222 (e.g., a second load). The other end of the resistance 222 is connected to the common wire 212.

The thermostat 112*b* includes a battery 224, an analog-to-digital converter (ADC) 206*b*, a microprocessor 208, a switch 210, and a temperature sensor 230. As shown the switch 210 is a single pole double throw (SPDT) switch or relay with an On-Off-On configuration, though other switches/relays and configurations are possible. Here, the switch 210 is currently in the off position. In the off position, no current is provided to heat control wire 216 nor the cooling control wire 218. When the switch 210 is moved to the first on position (heat position), current from the power wire 214 is provided to the heat control wire 216 which signals the HVAC system 120 to start the heat operation. In the heat position, no current is provided to the cooling control wire 218. When the switch 210 is moved to the second on position (cool position), current from the power wire 214 is provided to the cooling control wire 218 which signals the HVAC system 120 to start the cooling operation. The temperature sensor 230 may be a bimetallic mechanical or electric sensor, an electronic thermistor, a resistive temperature detector, a thermocouple, or a semi-conductor sensor. The output of the temperature sensor 230 may be provided to the microprocessor 208.

The ADC 206*b* receives the power wire 214 voltage as a first input and either the heat control wire 216 voltage as a second input or the cooling control wire 218 voltage as the second input. The ADC 206*b* may take a voltage differential between the two inputs and sample the resulting voltage in order to produce a digital signal. When the switch 210 is in the heat position, the ADC 206*b* uses channel 2 in order to receive the cooling control wire 218 voltage as the second input. When the switch 210 is in the heat position, the cooling control wire 218 is left open such that there is no current (or substantially no current) on the cooling control wire 218. As such, when the switch 210 is in the heat position, the cooling control wire 218 voltage is the same (or substantially the same) as the common wire 212 voltage. When the switch 210 is in the cool position, the ADC 206*b* uses channel 1 in order to receive the heat control wire 216 voltage as the second input. When the switch 210 is in the cool position, the heat control wire 216 is left open such that there is no current (or substantially no current) on the heat control wire 216. As such, when the switch 210 is in the cool position, the heat control wire 216 voltage is the same (or substantially the same) as the common wire 212 voltage. The ADC 206*b* may take a voltage differential between the two inputs and, thus, obtain the voltage across the transformer 202. The ADC 206*b* proceeds to sample the obtained transformer 202 voltage in order to produce a digital signal. This digital signal is then sent to the microprocessor 208 from the ADC 206*b*.

The microprocessor 208 analyzes the digital signal. In analyzing the digital signal, the microprocessor 208 may access a waveform model (e.g., accessed from storage on the thermostat 112*b* or received from the control unit 106 as shown in FIG. 1) and compare the digital signal with the accessed waveform. In comparing the digital signal with the accessed waveform, the microprocessor 208 may identify deviations in the digital signal from the waveform model. In some implementations, these deviations are further analyzed by the microprocessor 208.

Figure 3A:
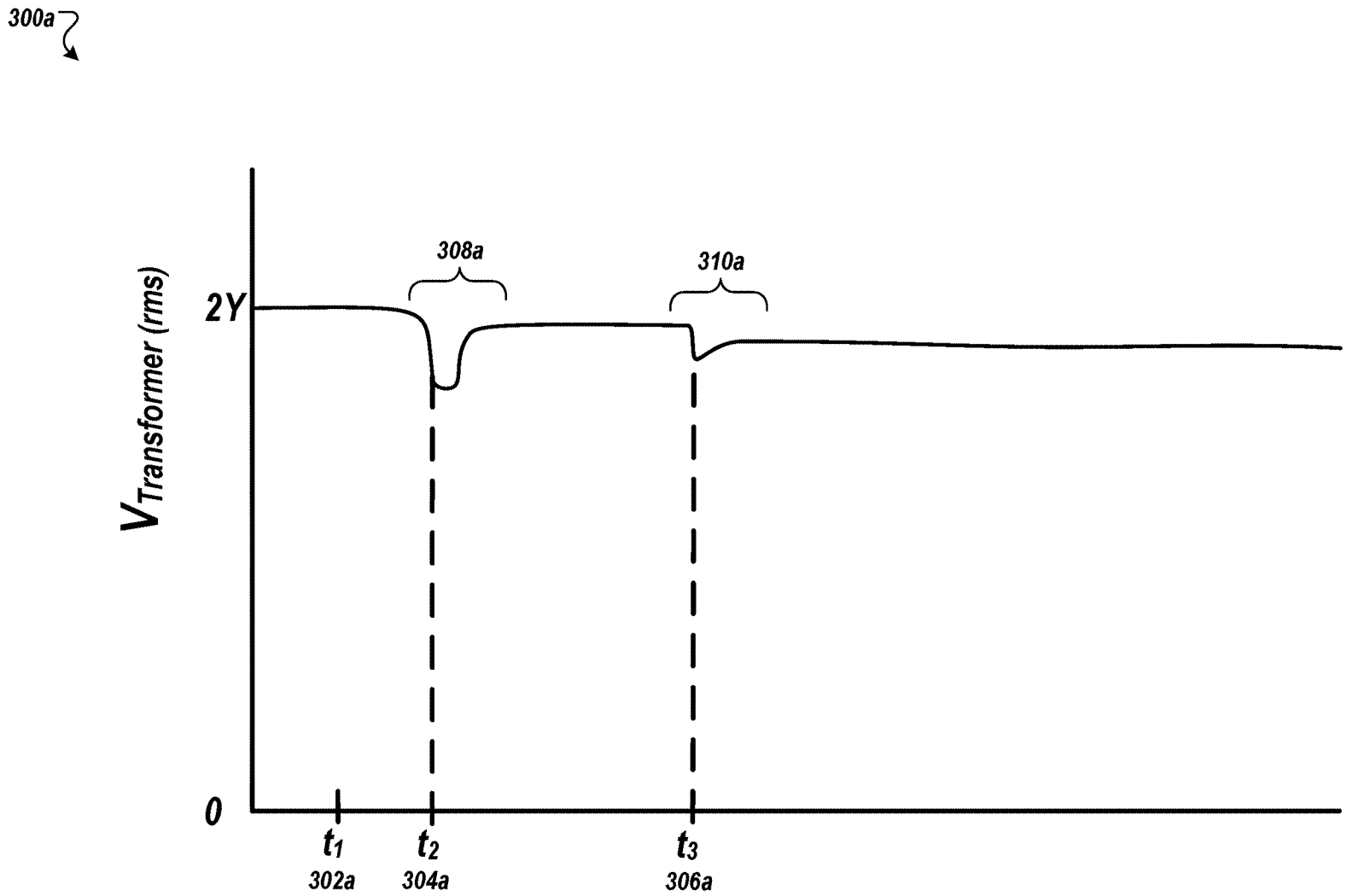
FIGS. 3A through 3B are diagrams of example waveform models.
Figure 3B:
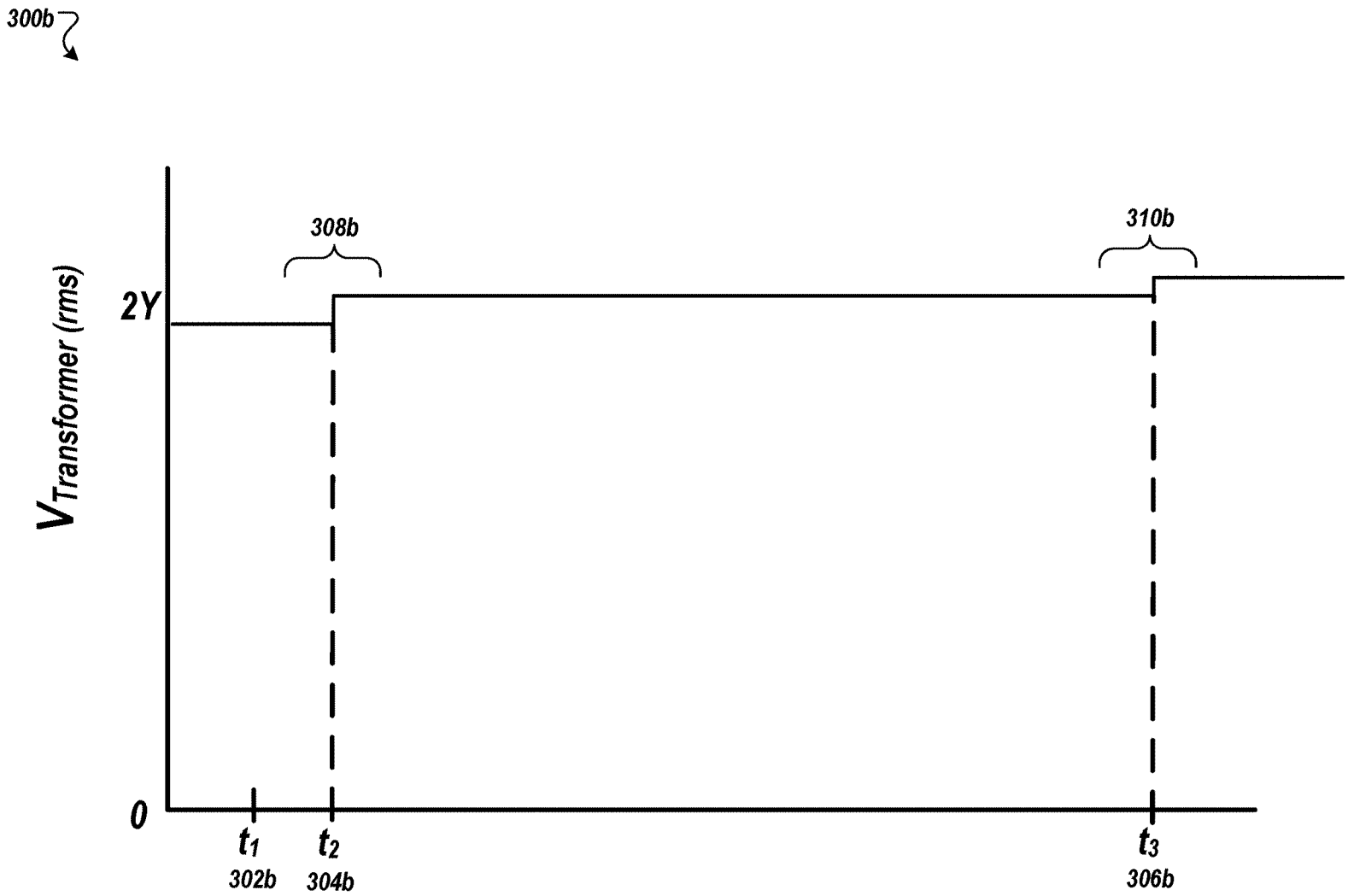

FIGS. 3A through 3B are diagrams of example waveform models. These waveform models are used by the system (e.g., security monitoring system 100 in FIG. 1) to determine abnormal HVAC operations by comparing it with a monitored waveform.

FIG. 3A depicts a voltage waveform model 300*a* for the HVAC system (e.g., the HVAC system 120 as shown in FIGS. 1-2B) going from an off state to a cooling start state. The waveform model 300*a* is model of the expected waveform that is to be monitored when the HVAC system is operating properly during this state transition. The waveform model 300*a* is a plot of root-mean-square (RMS)

voltage across the transformer (e.g., transformer 202 as shown in FIGS. 2A-2B) over time. The waveform model 300*a* has three notable times: a first time 302*a*, a second time 304*a*, and a third time 306*a*. The waveform model 300*b* also has two events: a first event 308*a* that starts at time 304*a*, and a second event 310*a* that starts at time 306*a*.

The time 302*a* correlates with a time at which a thermostat (e.g., thermostat 112 as shown in FIGS. 1-2B) sends a signal to the HVAC system (e.g., the HVAC system 120 as shown in FIGS. 1-2B) to start cooling. This signal may be provided through a change to a switch configuration (e.g., changing the configuration of switch 210 as shown in FIGS. 2A-2B from an off position to a cool position).

The time 304*a* correlates with the event 308*a* and a first operation of the HVAC system (e.g., the HVAC system 120 as shown in FIGS. 1-2B). Here, the first operation is the starting of the HVAC system's compressor (e.g., compressor 122 as shown in FIG. 1).

The time 306*a* correlates with the event 310*a* and a second operation of the HVAC system (e.g., the HVAC system 120 as shown in FIGS. 1-2B). Here, the second operation is the starting of the HVAC system's blower (e.g., blower 124 as shown in FIG. 1). The event 310*a* is slightly smaller than the event 308*a* due to, for example, the lower power consumption the blower 124 when compared with the compressor 122. During a comparison of the waveform model 300*a* with a monitored waveform (e.g., monitored waveform 156 as shown in FIG. 1), the security monitoring system 100 as shown in FIG. 1 may look at the size of any deviations in the monitored waveform in order to determine the source of the deviations (e.g., a larger deviation during a cooling transition may indicate the compressor as the cause, whereas a smaller deviation during a cooling transition may indicate the blower as the cause).

In some implementations, the security monitoring system 100 as shown in FIG. 1 is able to identify deviations in the monitored waveform that are associated with power cycling of other appliances outside of the HVAC system (e.g., the HVAC system 120 as shown in FIGS. 1-2B). These other appliances may include other appliances within the house (e.g., house 102 as shown in FIG. 1), such as one or more washing machines, dryers, refrigerators, dish washers, electric ovens, etc. These other appliances may include the appliances of a neighbor. The security monitoring system 100 may differentiate deviations in the monitored waveform from the deviations within the HVAC system itself by analyzing the time and amplitude of the deviations and/or comparing the analyzed deviations with known deviations. In these implementations, the security monitoring system 100 may differentiate deviations caused by other appliances within the house with those caused by other appliance with a neighbor's house by the amplitude of those deviations.

In these implementations, the security monitoring system 100 may use sensor data (e.g., from sensors 110 as shown in FIG. 1) to verify the power cycling of one or more other appliances. For example, the sensors may include smart plugs. In this example, the smart plugs may show that at a first time the power drawn from the smart plug stopped (or significantly slowed) and that at a second time the power drawn increased. Based on this information and/or based on additional information (e.g., the first time and the second time being occurring within a predetermined time period, such as 0.1 s, 0.2 s, 0.5 s, 1.0 s, 2.0 s, 10 s, 30 s, 1.0 minute, 2.0 minutes, 5.0 minutes, etc.), and based on a detected deviation which the security monitoring system 100 associates with an appliance, the security monitoring system 100 may verify that the a power cycle of the appliance caused the deviation and/or that the appliance experienced a power cycle.

The waveform model 300*a* may be produced with the methods described above with reference to FIG. 1. For example, the waveform model 300*a* may be created by a computer program based on the known components of the HVAC system (e.g., the HVAC system 120 as shown in FIGS. 1-2B) and possible other components (e.g., transformer 202 as shown in FIGS. 2A-2B). As another example, the waveform model 300*a* may be created using one or more monitored waveforms taken from when the HVAC system is operating properly. In such an example, the waveform model 300*a* may be updated overtime when new data comes available. As another example, the waveform model 300*a* may be initially created by a computer program based on the known components of the HVAC system and updated using one or more monitored waveforms. In these examples, when updating a waveform model, the security monitoring system 100 (as shown in FIG. 1) may implement a machine-learning network and use additional monitored waveforms (or data from such) as input.

FIG. 3B depicts a voltage waveform model 300*b* for the HVAC system (e.g., the HVAC system 120 as shown in FIGS. 1-2B) going from a cooling on state to an off state. The waveform model 300*b* is a model of the expected waveform that is to be monitored when the HVAC system is operating properly during this state transition. The waveform model 300*b* is a plot of RMS voltage across the transformer (e.g., transformer 202 as shown in FIGS. 2A-2B) over time. The waveform model 300*b* has three notable times: a first time 302*b*, a second time 304*b*, and a third time 306*b*. The waveform model 300*b* also has two events: a first event 308*b* that starts at time 304*b*, and a second event 310*b* that starts at time 306*b*.

The time 302*b* correlates with a time at which a thermostat (e.g., thermostat 112 as shown in FIGS. 1-2B) sends a signal to the HVAC system to stop cooling. The HVAC system may be the HVAC system 120 as shown in FIGS. 1-2B. This signal may be provided through a change to a switch configuration (e.g., changing the configuration of switch 210 as shown in FIGS. 2A-2B from a cool position to an off position).

The time 304*b* correlates with the event 308*b* and a first operation of the HVAC system (e.g., the HVAC system 120 as shown in FIGS. 1-2B). Here, the first operation is the stopping of the HVAC system's compressor (e.g., compressor 122 as shown in FIG. 1).

The time 306*b* correlates with the event 310*b* and a second operation of the HVAC system (e.g., the HVAC system 120 as shown in FIGS. 1-2B). Here, the second operation is the stopping of the HVAC system's blower (e.g., blower 124 as shown in FIG. 1). The event 310*b* is slightly smaller than the event 308*b* due to, for example, the lower power consumption the blower 124 when compared with the compressor 122. During a comparison of the waveform model 300*b* with a monitored waveform (e.g., monitored waveform 156 as shown in FIG. 1), the security monitoring system 100 (as shown in FIG. 1) may look at the size of any deviations in the monitored waveform in order to determine the source of the deviations (e.g., a larger deviation during a cooling transition may indicate the compressor as the cause, whereas a smaller deviation during a cooling transition may indicate the blower as the cause).

The waveform model 300*b* may be produced with the methods described above with reference to FIG. 1. For example, the waveform model 300*b* may be created by a computer program based on the known components of the HVAC system (e.g., the HVAC system 120 as shown in FIGS. 1-2B) and possible other components (e.g., transformer 202 as shown in FIGS. 2A-2B). As another example, the waveform model 300*b* may be created using one or more monitored waveforms taken from when the HVAC system is operating properly. In such an example, the waveform model 300*b* may be updated overtime when new data comes available. As another example, the waveform model 300*b* may be initially created by a computer program based on the known components of the HVAC system and updated using one or more monitored waveforms. In these examples, when updating a waveform model, the security monitoring system 100 (as shown in FIG. 1) may implement a machine-learning network or model and use additional monitored waveforms (or data from such) as input. Implementing a machine-learning network or model may be done as described above with reference to stage (D) of FIG. 1.

In some implementations, creating a waveform model for a transition from an on state to an off state, such as waveform model 300*b*, requires obtaining an expected timing offset. Such a time offset may be estimated based on the components of the HVAC system (e.g., the HVAC system 120 as shown in FIGS. 1-2B). For example, it may be known that the amount of time needed for the particular compressor (e.g., compressor 122 as shown in FIG. 1) of the HVAC system to turn off (i.e., the difference in time between times 304*b* and 302*b*) is about 0.1 seconds. Alternatively, the time offset may be determined based on an analysis of one or more monitored waveforms. The various components of the HVAC system may have different offsets. For example, as shown, the time offset for the compressor (e.g., the difference in time between times 304*b* and 302*b*) is smaller than the timing offset for the blower (e.g., the difference in time between times 306*b* and 302*b*).

Figure 4A:
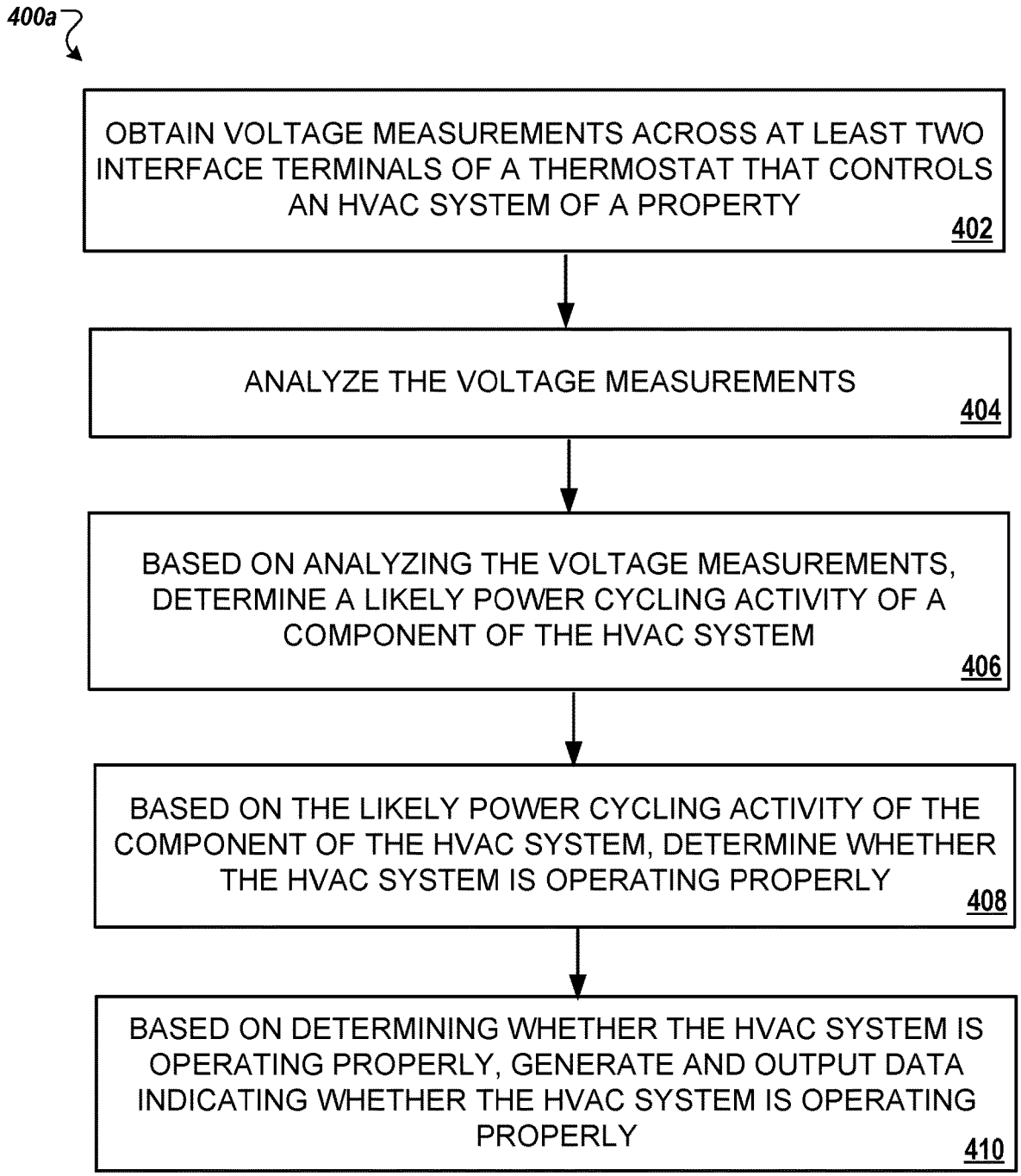
FIGS. 4A through 4B are flowcharts of example processes for monitoring an HVAC system.
Figure 4B:
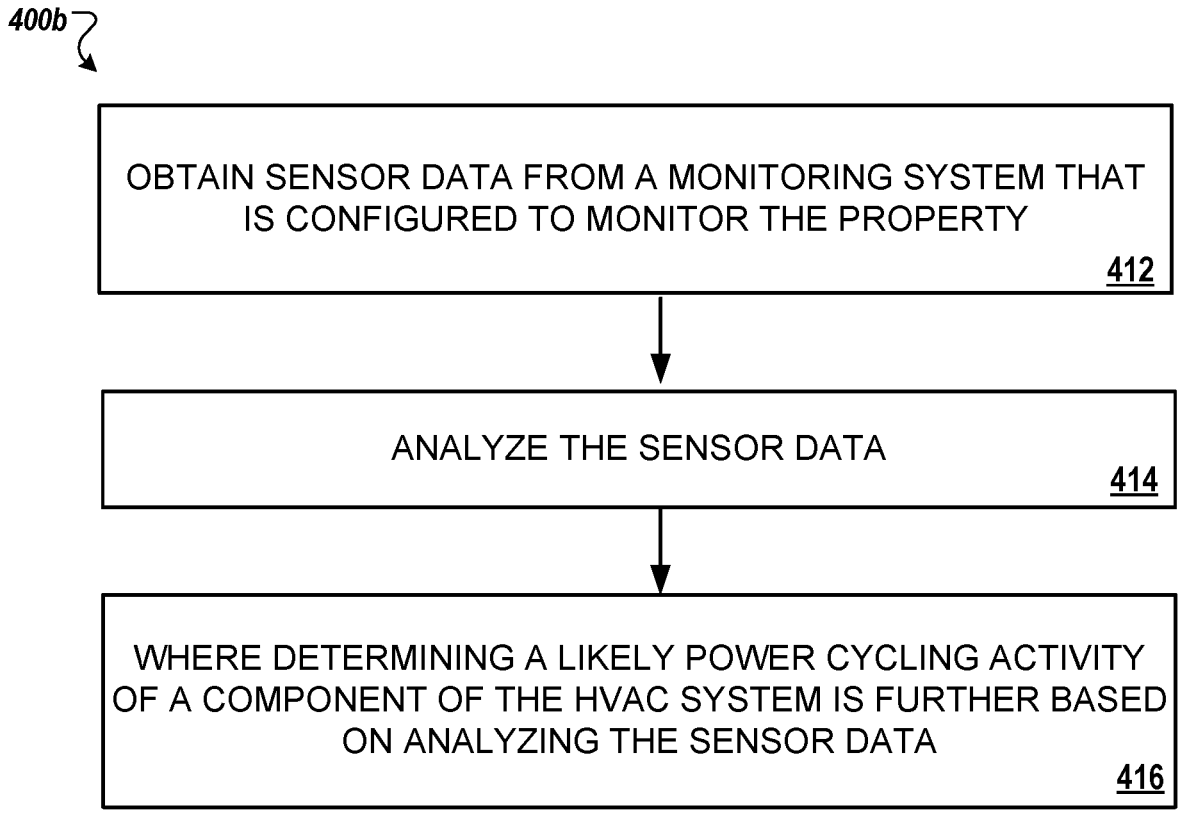

FIGS. 4A through 4B depict an example process 400 for advanced monitoring of an HVAC system.

FIG. 4A is a flowchart of an example process 400*a* for the advanced monitoring of an HVAC system. The process 400*a* can be performed, at least in part, using the security monitoring system 100 described herein or the security monitoring system 500 shown in FIG. 5.

The process 400*a* includes obtaining voltage measurements across at least two interface terminals of a thermostat that controls an HVAC system of a property (402). The voltage measurements may include a voltage waveform, or can be used to generate a voltage waveform (e.g., by sampling the voltage measurements). The voltage measurements may be taken by the thermostat (e.g., thermostat 112 as shown in FIGS. 1-2B). The voltage measurements can include measurements of AC voltage. For example, with respect to FIG. 1, the voltage measurements can include the AC voltage monitored across the communication link 144 between the thermostat 112 and the HVAC system 120. The voltage measurements can include voltage measurements across power supply lines such as a power wire and a common wire. The interface terminals may include a common wire and a power wire of the thermostat wiring interface. As an example, with respect to FIG. 1, the common wire and the power wire may be part of the communication link 144 between the thermostat 112 and the HVAC system 120.

In some cases, obtaining voltage measurements across at least two interface terminals of the thermostat includes obtaining voltage measurements for a preset period of time. For example, with respect to FIG. 1, the thermostat 112 can monitor the voltage across the power supply lines of the communication link 144 for a preset period of time (e.g., 0.1 s, 0.2 s, 0.5 s, 1 s, 2 s, etc.). The preset period of time can correspond to a type of signal generated by the thermostat 112 and sent to the HVAC system 120 (e.g., heating versus cooling signal, and/or start signal versus stop signal). For example, the preset period of time to monitor voltage can be 0.9 seconds for a cooling signal (e.g., which can correspond to the maximum amount of time to turn on the cooling components of the HVAC system 120 and/or turn off the heating components of the HVAC system 120), while the preset period of time to monitor voltage can be 1.4 seconds for a heating signal (e.g., which can correspond to the maximum amount of time to turn on the heating components of the HVAC system 120 and/or turn off the cooling components of the HVAC system 120).

The process 400*a* includes analyzing the voltage measurements (404). The voltage measurements may be analyzed by the thermostat itself. The voltage measurements may be analyzed by the security monitoring system 100 or 500 shown in FIGS. 1 and 5. Analyzing the voltage measurements may include comparing the measured voltage, such as monitored voltage waveform, with a waveform model. Analyzing the voltage measurements may include providing the measured voltage to one or more machine learning models or networks and analyzing the output of the one or more machine learning models or networks. Analyzing the voltage measurements may include detecting deviations in the voltage measurements from an expected voltage measurement.

In some cases, analyzing the voltage measurements includes identifying an operation of the HVAC system corresponding to the voltage measurements. The operation can indicate expected power cycling activities of components of the HVAC system and expected states of the components of the HVAC system. The operation can be a particular signal, or can otherwise correspond to a particular signal. The signal can be a signal generated by the thermostat to be sent to the HVAC system. For example, with respect to FIG. 1, a cooling start signal sent by the thermostat 112 can correspond to a cooling operation. Similarly, a heating start signal sent by the thermostat 112 can correspond to a heating operation.

As an example, with respect to FIG. 1, the thermostat 112 can identify a signal that was sent to the HVAC system 120 (e.g., cooling start signal, heating start signal, cooling stop signal, heating stop signal, etc. sent by the thermostat 112) prior to obtaining the voltage measurements or while obtaining the voltage measurements. The thermostat 112 can use the signal to determine expected power cycling events and expected states of the components of the HVAC system 120. For example, if the thermostat 112 provided a cooling signal to the HVAC system 120, the thermostat 112 can determine that the expected power cycling events following the cooling signal (e.g., until the thermostat 112 sent a different signal to the HVAC system 120) include turning on the air conditioning compressor 122, turning on the blower 124, turning off the heating element 128, etc. Similarly, the thermostat 112 can determine the following expected states of components of the HVAC system 120 based on the cooling signal: the air conditioning compressor 122 is on, the blower 124 is on, the heating element 128 is off, etc.

Continuing the last example, analyzing the voltage measurements can include the thermostat 112 using the voltage measurements to verify that one or more expected power cycling activities have occurred. Analyzing the voltage measurements can include the thermostat 112 using the voltage measurements to verify that the state of one or more components of the HVAC system 120 match the expected state(s) of those one or more components. Similarly, analyzing the voltage measurements can include the thermostat 112 using the voltage measurements to determine that one or more unexpected power cycling activities have occurred. Analyzing the voltage measurements can include the thermostat 112 using the voltage measurements to determine that a state of one or more components of the HVAC system 120 do not match the expected state(s) of those one or more components.

In some cases, analyzing the voltage measurements includes applying one or more voltage thresholds to the voltage measurements, and determining the likely power cycling activity based on which of the one or more voltage thresholds are met. As an example, the thermostat 112 can apply one or more voltage threshold to the voltage measurements (e.g., to the monitored waveform 156). If a first voltage threshold is met but not a second voltage threshold, this may indicate to the thermostat 112 that a stop event has occurred (e.g., a stop event of a component of the HVAC system 120 or of an appliance of the property 102). If both the first voltage threshold and the second voltage threshold are met, this may indicate to the thermostat 112 that a start event has occurred.

The process 400*a* includes, based on analyzing the voltage measurements, determining a likely power cycling activity of a component of the HVAC system (406). Determining a likely power cycling activity may include comparing the results of the voltage analysis with known power cycling events. These power cycling events may include expected events, such as the start of a compressor when a cooling signal is provided, and may include unexpected events, such as the early shutoff of an HVAC blower or multiple compressor start attempts. For example, the monitoring system may determine a likely power cycling activity based on the voltage measurements having a deviation similar to a known deviation for an early shutoff and restart of the heating unit.

In some cases, determining a likely power cycling activity of a component of the HVAC system includes identifying from the voltage measurements a stop or start event, determining a state of the thermostat to identify one or more commands sent by the thermostat to the HVAC system, and, based on the one or more commands and the stop or start event, identifying the likely power cycling activity of the component of the HVAC system. As an example, with respect to FIG. 1, the thermostat 112 can apply one or more voltage thresholds to the voltage measurements (e.g., to the monitored waveform 156). In applying the one or more voltage thresholds to the voltage measurements (e.g., to the monitored waveform 156), the thermostat 112 can determine whether a turn-off/stop event or a turn-on/start event has occurred.

In some cases, the thermostat 112 does not differentiate between stop/start events of different components (e.g., components of the HVAC system 120 and/or appliances in the property 102). Accordingly, the one or more thresholds may be general to various components, e.g., general to all components of the HVAC system 120 and/or appliances of the property 102 (e.g., dryer, oven, water heater, pool pump, etc.). As an example, if a first voltage threshold is met but not a second voltage threshold, this may indicate to the thermostat 112 that a stop event has occurred (e.g., a stop event of a component of the HVAC system 120 or of an appliance of the property 102). If both the first voltage threshold and the second voltage threshold are met, this may indicate to the thermostat 112 that a start event has occurred.

In some cases, the thermostat 112 or the control unit 106 does differentiate between stop/start events of different components. The thermostat 112 or the control unit 106 can use a machine learning model or network to look for a stop/start event signature of a particular component to determine the state of the component.

Continuing with the previous example, the thermostat 112 can also identify a state of the thermostat 112. The states of the thermostat 112 can include, for example, a cooling state, a heating state, a cooling off state, a heating off state, and/or an off state. The states of thermostat 112 may each correspond to one or more commands to the HVAC system 120's components. For example, the cooling state can correspond to the thermostat 112 sending a command to turn on the compressor 122, a command to turn on the blower 124, and/or a command to turn off the heating element 128. A heating state can correspond to the thermostat 112 sending a command to turn on the heating element 128, a command to turn on the blower 124, and/or a command to turn off the compressor 122. The thermostat 112 can use its current state to identify the commands it sent to the HVAC system 120.

Continuing with the previous example, the thermostat 112 can also lookup a time when it switched states and/or time(s) when the one or more commands were sent to the HVAC system 120. The thermostat 112 can use these one or more times to create one or more time periods in which to identify power cycling activity. For example, for the commands associated with a cooling state, the thermostat 112 may create a first time period of 0.0 s to 0.2 s from the time of the state switch, a second time period of 0.2 s to 0.3 s from the time of the state switch, and a third time period of 0.3 s to 0.5 s from the time of the state switch. The first time period can indicate a time period when the power cycling activity of turning off the heating element 128 is likely to be identified. The second time period can indicate a time period when the power cycling activity of turning on the compressor 122 is likely to be identified. The third time period can indicate a time period when the power cycling activity of turning on the blower 124 is likely to be identified. As an example, if the thermostat 112 identifies a start event in the second time period, the thermostat 112 would determine that the power cycling activity is the turning on of the compressor 122 if the thermostat 112 was in a cooling state. Alternatively, when the thermostat 112 knows the times when each of the commands are sent, the thermostat 112 may create time periods following the command sent times. For example, for the commands associated with a cooling state, the thermostat 112 may create a first time period of 0.0 s to 0.2 s from the time that a command to turn off the heating element 128 was sent, a second time period of 0.0 s to 0.3 s from the time that a command to turn on the compressor 122 was sent, and a third time period of 0.0 to 0.4 s from the time that a command to turn on the blower 124 was sent.

As another example, for the commands associated with a heating state, the thermostat may create a first time period of 0.0 s to 0.3 s from the time of the state switch, a second time period of 0.3 s to 0.8 s from the time of the state switch, and a third time period of 0.8 s to 1.0 s from the time of the state switch. The first time period can indicate a time period when the power cycling activity of turning off the compressor 122 is likely to be identified. The second time period can indicate a time period when the power cycling activity of turning on the heating element 128 is likely to be identified. The third time period can indicate a time period when the power cycling activity of turning on the blower 124 is likely to be identified. As an example, if the thermostat 112 identifies a start event in the second time period, the thermostat 112 would determine that the power cycling activity is the turning on of the heating element 128 if the thermostat 112 was in a heating state. Alternatively, as described above, when the thermostat 112 knows the times when each of the commands are sent, the thermostat 112 may create time periods following the command sent times. For example, for the commands associated with a heating state, the thermostat 112 may create a first time period of 0.0 s to 0.3 s from the time that a command to turn off the compressor 122 was sent, a second time period of 0.0 s to 0.4 s from the time that a command to turn on the heating element 128 was sent, and a third time period of 0.0 to 0.4 s from the time that a command to turn on the blower 124 was sent.

In some cases, determining the likely power cycling activity of the component of the HVAC system includes identifying a voltage waveform from the voltage measurements, identifying one or more deviations in the voltage waveform from a waveform model, determining that the one or more deviations match one or more known voltage deviations, and determining the likely power cycling activity as the power cycling activity that corresponds to the one or more known voltage deviations. For example, with respect to FIG. 1, identifying the voltage waveform from the voltage measurements can include identifying the monitored waveform 156 by sampling the monitored AC voltage across the communication link 144 from the thermostat 112 to the HVAC system 120. Additionally or alternatively, identifying the voltage waveform from the voltage measurements can include the thermostat 112 converting a sampled waveform such as the monitored waveform 156 into a parameterized waveform (e.g., a waveform of the changes of the RMS voltage of the sampled waveform).

As an example, with respect to FIG. 1, identifying one or more deviations in the monitored waveform 156 from the waveform model 152 can include the thermostat 112 identifying the events 158*b*-158*c* as deviations due to the waveform model 152 not including any corresponding events (e.g., events of a similar amplitude, frequency, time with respect to other events, time with respect to a signal, length of time, etc.). In identifying one or more deviations in the monitored waveform 156 from the waveform model 152, the thermostat can first identify all events in the monitored waveform 156. The thermostat 112 can identify the events by determining areas of the monitored waveform 156 that meet a threshold amplitude and phase of the monitored waveform 156 (e.g., at 60 Hz), that meet a threshold amplitude and phase of harmonics, and/or that are abrupt/unusual departures in the monitored waveform 156. The thermostat 112 can perform the same process with respect to the waveform model 152 to identify the event 154 in the waveform model 152. Alternatively, the event 154 may have been previously identified.

As an example, with respect to FIG. 1, determining that the one or more deviations match one or more known voltage deviations can include determining that the portion of the monitored waveform 156 corresponding to the event 158*b* and/or the event 158*c* has a similar shape, amplitude, frequency, start/end time with respect to one or more other events, start/end time with respect to a signal (e.g., a time since a cooling start signal was sent by the thermostat 112 to the HVAC system 120), and/or length of time as a known event.

The known voltage deviations can correspond to different power cycling activities, e.g., events. For example, with respect to FIG. 1, the known voltage deviations can include events that have been previously monitored by the thermostat 112 or that are expected based on the model of the HVAC system 120 or the models of components of the HVAC system 120, such as the event 154. The event 154 can correspond to the power cycling activity of starting the compressor 122. As an example, an amplitude of the event 158*b* (e.g., at multiple times, or at all times) may be within a threshold amplitude of an amplitude of the event 154. Similarly, the length of time corresponding to the event 158*b* (e.g., time that elapsed between the start time and the end time of the event 158*b*) may be within a threshold time of a length of time of the event 154. Based on this, the thermostat 112 can determine that the deviation corresponding to the event 158*b* matches the event 154.

Determining the likely power cycling activity as the power cycling activity that corresponds to the one or more known voltage deviations can be in response to the determination that the one or more deviations match the one or more known voltage deviations. As an example, continuing the previous example with respect to FIG. 1, determining the likely power cycling activity as the power cycling activity that corresponds to the one or more known voltage deviations can include determining that the event 158*b* corresponds to the power cycling activity of starting the compressor 122 in response to determining that the event 158*b* matches the event 154.

In some cases, the process 400*a* includes obtaining a waveform model. The waveform model can correspond to a signal generated by the thermostat or by the HVAC system. The signal indicates that one or more components of the HVAC system should be turned on or have been turned on. Additionally or alternatively, the signal indicates that one or more components of the HVAC system should be turned off or have been turned off. For example, with respect to FIG. 1, the waveform model 152 can correspond to a signal generated by the thermostat 112 and sent to the HVAC system 120. Specifically, the waveform model 152 can correspond to a cooling signal generated by the thermostat 112, a heating signal generated by the thermostat 112, a cooling off signal generated by the thermostat 112, a heating off signal generated by the thermostat 112, etc. Similarly, the waveform model 152 can correspond to a signal of the HVAC system 120 or an operation of the HVAC system 120 as described above. A signal of the HVAC system 120 can indicate, for example, one or more of that a signal from the thermostat 112 has been received (and is being processed or has been processed by the HVAC system 120), a current operation of the HVAC system 120, or that one or more components of the HVAC system 120 have been turned on/off.

The waveform model can additionally or alternatively correspond to one or more of the HVAC system, components of the HVAC system, models of components of the HVAC system, the component of the HVAC system, or a model of the component of the HVAC system. For example, with respect to FIG. 1, the waveform model 152 can correspond to a particular model of air conditioning compressor. Specifically, the waveform model 152 can correspond to the model of air condition compressor that the compressor 122 is.

The waveform model can indicate, for example, expected power cycling activities of components of the HVAC system and/or expected states of components of the HVAC system. For example, with respect to FIG. 1, the waveform model 152 can correspond to a cooling start signal. The waveform model 152 can indicate that an expected power cycling activity in response to the cooling start signal is that the compressor 122 should be turned from an off state to an on state due to the inclusion of the event 154 in the waveform model 152 (e.g., which corresponds with an attempted start of the compressor 122, or with an attempted start of a model of air conditioning compressor that is the same as the compressor 122). Similarly, the waveform model 152 can indicate that an expected state of the compressor 122 following the cooling start signal is an on state due to the inclusion of the event 154 in the waveform model 152.

In some cases, the process 400*a* includes obtaining known voltage deviations. The known voltage deviations can correspond to one or more of power cycling events of components of the HVAC system, models of components of the HVAC system, the component of the HVAC system, a model of the component of the HVAC system, or electronic devices outside of the HVAC system. For example, with respect to FIG. 1, the event 154 can correspond to the power cycling event of starting the compressor 122, or for starting an air conditioning that is the same model of the compressor 122. The thermostat 112 can treat the event 154 as a known voltage deviation, e.g., when the event 154 occurs more than an expected number of times (e.g., occurs more than once), when it occurs at a time (e.g., relative to a signal, and/or relative to one or more other events) that is sufficiently different from an expected time (e.g., the start time of the event is later than a threshold time since an expected start time based on the waveform model 152), etc. For example, a known voltage deviation can be a failed start of the compressor 122. This known voltage deviation may have the same amplitude and phase as the event 154.

In some cases, determining that the one or more deviations match the one or more known voltage deviations includes determining that the one or more deviations are within one or more of a threshold amplitude or a threshold frequency (e.g., phase) from the one or more known voltage deviations. For example, with respect to FIG. 1, the thermostat 112 can determine that the deviation corresponding to event 158*c* matches the event 154 due to the amplitude of the event 158*c* (e.g., at multiple times or at all sampled times) is the same or is within a threshold amplitude of an amplitude of the event 154, and that the frequency of the event 158*c* is the same or is within a threshold frequency (e.g., threshold phase difference) of a frequency of the event 154.

In some cases, determining the likely power cycling activity of the component of the HVAC system includes determining one or more of: the component of the HVAC system turned off; the component of the HVAC system turned on; the component of the HVAC system turned off and then turned on; or the component of the HVAC system turned on and then turned off. For example, with respect to FIG. 1, based on determining that the event 158*c* matched the event 154 and that the event 154 corresponds to the power cycling activity of starting the compressor 122 (or starting a model of air conditioning compressor that the compressor 122 is), the thermometer can determine that the likely power cycling activity is the starting of the compressor 122. The thermostat 112 may additionally determine that the power cycling activities of the compressor 122 also included two failed starts of the compressor 122 based on the events 158*a*-158*b* also matching the event 154.

In some cases, determining that the component of the HVAC system turned off includes determining that power drawn by the component of the HVAC system stopped or substantially stopped. Similarly, determining that the component of the HVAC system turned on includes determining the component of the HVAC system is drawing power or a threshold amount of power. Sensor data can indicate the power drawn by components of the HVAC system, e.g., can indicate that a given component is off or is on. In turn, the HVAC system can use the sensor data to confirm one or more start/stop events (and/or to confirm the success of the start/stop events) corresponding to components of the HVAC system determined from the voltage measurements. For example, with respect to FIG. 1, the control unit 106 can receive sensor data from a smart plug that is connected to the compressor 122 and a power supply. The data can indicate that the power drawn by the compressor 122 has stopped or has substantially stopped. The control unit 106 can use this data along with a determination that the voltage measurements indicate a stop event and that the state of the thermostat 112 indicates that a stop command was sent to the compressor 122 to verify that the compressor 122 is stopped/off, to verify that the HVAC system 120 is operating properly, etc. Alternatively, the control unit 106 can provide the sensor data to the thermostat 112. The thermostat 112 can use the sensor data to verify that the state of the compressor 122 is stopped/off, that the HVAC system 120 is operating properly, etc.

The process 400*a* includes, based on the likely power cycling activity of the component of the HVAC system, determining whether the HVAC system operating properly (408). This may include the monitoring system determining that the power cycling activity matched or was similar enough to an expected power cycling activity. For example, where a cooling signal is provided by the thermostat to the HVAC system, the monitoring system may determine that there was a start of the compressor and a start of a blower without incident. The HVAC system may use the obtained sensor data to verify that HVAC system components were operating properly. For example, the HVAC system may analyze the data from one or more smart plugs to verify that there were no failed starts of the compressor or the blower, and/or verify that there were no unexpected shutdowns of the compressor or the blower during operation.

In some cases, determining whether the HVAC system is operating properly includes identifying an operation of the HVAC system corresponding to the voltage measurements. The operation can indicate expected power cycling activities of components of the HVAC system and expected states of the components of the HVAC system. The operation can be a particular signal, or can otherwise correspond to a particular signal. The signal can be a signal generated by the thermostat to be sent to the HVAC system. For example, with respect to FIG. 1, a cooling start signal sent by the thermostat 112 can correspond to a cooling operation. The cooling operation can indicate the following power cycling activities: the compressor 122 should be turned on (e.g., if off), that the blower 124 should be turned on (e.g., if off), the heating element 128 should be turned off (e.g., if on), etc. The cooling operation can indicate the following states of components of the HVAC system 120: the compressor 122 should be on, the blower 124 should be on, the heating element 128 should be off, etc. Similarly, a heating start signal sent by the thermostat 112 can correspond to a heating operation. The heating operation can indicate the following power cycling activities: the heating element 128 should be turned on (e.g., if off), that the blower 124 should be turned on (e.g., if off), the compressor 122 should be turned off (e.g., if on), etc. The heating operation can indicate the following states of components of the HVAC system 120: the compressor 122 should be off, the blower 124 should be on, the heating element 128 should be on, etc.

As an example, determining that the HVAC system is operating properly if the likely power cycling activity of the component of the HVAC system is an expected power cycling activity of the expected power cycling activities. For example, with respect to FIG. 1, the thermostat 112 may determine that the HVAC system 120 is operating properly if the monitored waveform 156 did not include the events 158*b*-158*c* due to the event 158*a* matching the event 154 (e.g., expected event), and due to the event 154 corresponding to the expected power cycling activity of starting the compressor 122. The starting of the compressor 122 may be an expected power cycling activity based on the cooling start signal generated by the thermostat 112 and sent to the HVAC system 120, e.g., where the cooling start signal may be used by the thermostat 112 to select the waveform model 152.

As an example, determining that the HVAC system is operating improperly if the likely power cycling activity of the component of the HVAC system is not an expected power cycling activity of the power cycling activities. For example, with respect to FIG. 1, the thermostat 112 may determine that the HVAC system 120 is operating improperly based on the monitored waveform 156 including the events 158*b*-158*c* which correspond to power cycling activities that were not expected. Although the events 158*b*-158*c* each match the event 154, the thermostat 112 can still determine that they indicate unexpected power cycling activities since there were no events in the waveform model 152 that correspond to the events 158*b*-158*c*, they indicate that a power cycling activity corresponding to the event 154 occurred more than an expected number of times (e.g., three events similar to the event 154 occurred, when only a single such event was expected), and/or they indicate that power cycling activity corresponding to the event 154 occurred at a time that was not expected (e.g., started a threshold time later than expected). Specifically, these unexpected events can indicate to the thermostat 112 that there were multiple failed attempts to start the compressor 122. Based on identifying one or more unexpected cycling activities (or unexpected states of components of the HVAC system 120), the thermostat 112 can determine that the HVAC system 120 is operating improperly.

In some case, the process 400*a* includes obtaining sensor data and using the sensor data to make a verification. For example, with respect to FIG. 1, control unit 106 can request and receive data from the sensors 110. The sensors 110 can include, for example, smart plugs, and the sensor data can include indications of power drawn by various electronic devices in the property 102, including components of the HVAC system 120. Similarly, the thermostat 112 can receive sensor data collected by the control unit 106.

Using the sensor data to make a verification can include using the sensor data to independently verify one or more of that the component of the HVAC system experienced the likely power cycling activity, that a state of the component of the HVAC system matches an expected state of the component of the HVAC system based on the operation, a state of the component of the HVAC system does not match an expected state of the component of the HVAC system based on the operation, that power cycling activities experienced by the component of the HVAC system other than the likely power cycling activity match expected power cycling activities of the component of the HVAC system based on the operation, that power cycling activities experienced by the component of the HVAC system other than the likely power cycling activity do not match expected power cycling activities of the component of the HVAC system based on the operation, the states of other components of the HVAC system match expected states of other components of the HVAC system based on the operation, the states of other components of the HVAC system do not match expected states of other components of the HVAC system based on the operation, that power cycling activities of other components of the HVAC system match expected power cycling activities of other components of the HVAC system based on the operation, or that power cycling activities of other components of the HVAC system do not match expected power cycling activities of other components of the HVAC system based on the operation.

For example, with respect to FIG. 1, the thermostat 112 and/or the control unit 106 can use the sensor to independently verify one or more of that the compressor 122 was started, that an attempt was made to start the compressor 122, that the compressor 122 is off, that the compressor 122 is on, that the compressor 122 experienced two failed starts, that the heating element 128 is off, etc.

Figure 5:
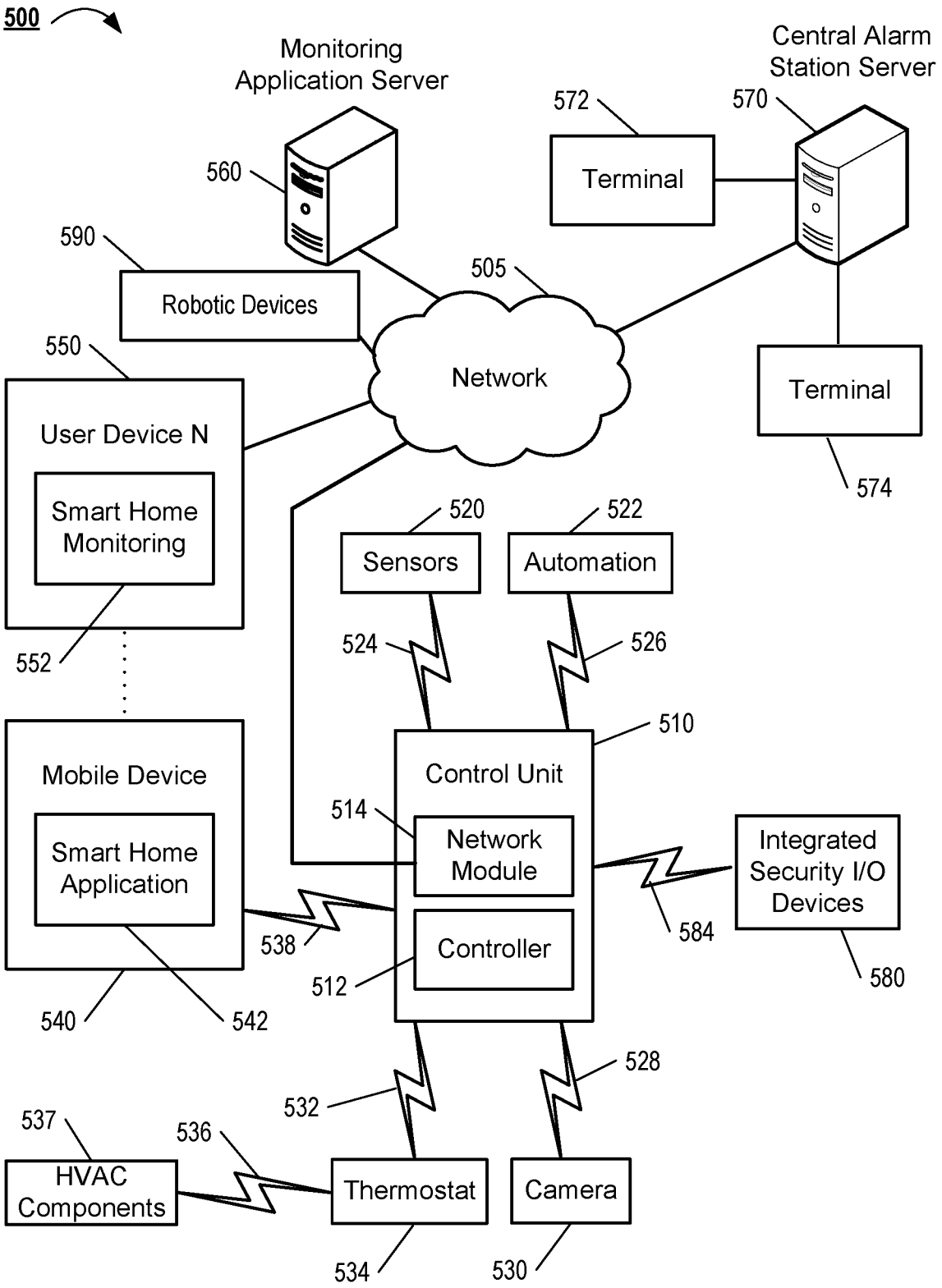
FIG. 5 is a block diagram illustrating an example security monitoring system.

The process 400*a* includes, based on determining whether the HVAC system is operating properly, generating and outputting data indicating whether the HVAC system is operating properly (410). This data may be generated by the monitoring system (e.g., the security monitoring system 100 or 500 as shown in FIGS. 1 and 5, respectively). This data may be outputted to a device belonging to an owner of the monitored property. This data may be outputted to a technician device belonging to a technician. In some implementations, the data is only outputted to a technician if a problem with a component of the HVAC system is detected.

In some cases, generating and outputting the data indicating whether the HVAC system is operating properly includes generating information that includes one or more of an indication that the HVAC system is operating properly, an indication that the HVAC system is operating improperly, indications of unexpected power cycling activities, indications of components of the HVAC system that experienced unexpected power cycling activities, indications of unexpected states of components of the HVAC system, or indications of components of the HVAC system that have an unexpected state. For example, with respect to FIG. 1, the thermostat 112 can generate the data packet 160. The data packet 160 can include information indicating that abnormal HVAC operations have been detected. The data packet 160 may contain additional information indicating, for example, the type of abnormal operations detected, the number of abnormal operations, the signal provided by the thermostat 112 to the HVAC system 120 (here, a signal to start cooling), etc.

Generating and outputting the data indicating whether the HVAC system is operating properly can also include providing the information to a device. For example, with respect to FIG. 1, the thermostat 112 can provide the data packet 160 to the control unit 106. In some cases, the thermostat 112 can generate a notification, and can provide the notification to the client device 166 or to a device of a technician of the HVAC system 120.

FIG. 4B is a flowchart of an example process 400*b* for the advanced monitoring of an HVAC system. The process 400*b* can be performed, at least in part, using the security monitoring system 100 described herein or the security monitoring system 500 shown in FIG. 5.

The process 400*b* includes obtaining sensor data from a monitoring system that is configured to monitor the property (412). The sensor data may include temperature data, video feed data, visible-light camera data, IR camera data, smart plug data, motion sensor data, window sensor data, and/or door sensor data. The property may include a house or another residential building. The monitoring system may be the security monitoring system 110 as shown in FIG. 1 or the security monitoring system 500 as shown in FIG. 5.

The process 400*b* includes analyzing the sensor data (414). Analyzing the sensor data may include determining the occurrence of an event based on the sensor data. These events may include power cycling events. For example, the sensors may include smart plugs and the sensor data may be smart plug data. In this example, an analysis of the smart plug data corresponding to a particular smart plug reveals that the power drawn from the smart plug stopped (or significantly slowed) at a first time and that the power drawn resumed or increased at a second time. Accordingly, such analysis may indicate that an appliance coupled to the particular smart plug experienced a power cycle event.

The process 400*b* includes where determining a likely power cycling activity of a component of the HVAC system is further based on analyzing the sensor data (416). Determining a likely power cycling activity may include comparing the results of the voltage analysis with known power cycling events and verifying the results of the comparison with the analyzed the sensor data. For example, based on the analysis of smart plug data and based on a detected deviation which the security monitoring system associates with an appliance, the security monitoring system may verify that the a power cycle of the appliance caused the deviation and/or that the appliance experienced a power cycle.

The process 400*a* as shown in FIG. 4A and the process 400*b* as shown in FIG. 4B can be combined into a single process. One or more steps of the process 400*b* may occur before, after, or at the same time or as part of as one or more steps of the process 400*a*. As an example, the process 400*b* may follow the process 400*a*. As an example, obtaining voltage measurements across at least two interface terminals of a thermostat that controls an HVAC system of a property (402 of process 400*a*) may include obtaining sensor data from a monitoring system that is configured to monitor the property (412 of process 400*b*). In this example, analyzing the voltage measurements (404 of process 400*a*) may include analyzing the sensor data (414 of process 400*b*). In this example, based on analyzing the voltage measurements, determining a likely power cycling activity of a component of the HVAC system (406 of process 400*a*) may include where determining a likely power cycling activity of a component of the HVAC system is further based on analyzing the sensor data (416 of process 400*b*).

FIG. 5 is a block diagram of an example security monitoring system 500. The system 500 includes a network 505, a control unit 510, one or more user devices 540 and 550, a monitoring server 560, and a central alarm station server 570. In some examples, the network 505 facilitates communications between the control unit 510, the one or more user devices 540 and 550, the monitoring server 560, and the central alarm station server 570.

In some implementations, the system 500 is the security monitoring system 108 as shown in FIGS. 1A-2D.

The network 505 is configured to enable exchange of electronic communications between devices connected to the network 505. For example, the network 505 may be configured to enable exchange of electronic communications between the control unit 510, the one or more user devices 540 and 550, the monitoring server 560, and the central alarm station server 570. The network 505 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 505 may include multiple networks or subnetworks, each of which may include, for example, a wired or wireless data pathway. The network 505 may include a circuit-switched network, a packet-switched data network, or any other network able to carry electronic communications (e.g., data or voice communications). For example, the network 505 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 505 may include one or more networks that include wireless data channels and wireless voice channels. The network 505 may be a wireless network, a broadband network, or a combination of networks including a wireless network and a broadband network.

The control unit 510 includes a controller 512 and a network module 514. The controller 512 is configured to control a control unit monitoring system (e.g., a control unit system) that includes the control unit 510. In some examples, the controller 512 may include a processor or other control circuitry configured to execute instructions of a program that controls operation of a control unit system. In these examples, the controller 512 may be configured to receive input from sensors, flow meters, or other devices included in the control unit system and control operations of devices included in the household (e.g., speakers, lights, doors, etc.). For example, the controller 512 may be configured to control operation of the network module 514 included in the control unit 510.

The network module 514 is a communication device configured to exchange communications over the network 505. The network module 514 may be a wireless communication module configured to exchange wireless communications over the network 505. For example, the network module 514 may be a wireless communication device configured to exchange communications over a wireless data channel and a wireless voice channel. In this example, the network module 514 may transmit alarm data over a wireless data channel and establish a two-way voice communication session over a wireless voice channel. The wireless communication device may include one or more of a LTE module, a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 514 also may be a wired communication module configured to exchange communications over the network 505 using a wired connection. For instance, the network module 514 may be a modem, a network interface card, or another type of network interface device. The network module 514 may be an Ethernet network card configured to enable the control unit 510 to communicate over a local area network and/or the Internet. The network module 514 also may be a voice band modem configured to enable the alarm panel to communicate over the telephone lines of Plain Old Telephone Systems (POTS).

The control unit system that includes the control unit 510 includes one or more sensors. For example, the monitoring system may include multiple sensors 520. The sensors 520 may include a lock sensor, a contact sensor, a motion sensor, or any other type of sensor included in a control unit system. The sensors 520 also may include an environmental sensor, such as a temperature sensor, a water sensor, a rain sensor, a wind sensor, a light sensor, a smoke detector, a carbon monoxide detector, an air quality sensor, etc. The sensors 520 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the sensors 520 may include a radio-frequency identification (RFID) sensor that identifies a particular article that includes a pre-assigned RFID tag.

The control unit 510 communicates with the module 522 and the camera 530 to perform monitoring. The module 522 is connected to one or more devices that enable home automation control. For instance, the module 522 may be connected to one or more lighting systems and may be configured to control operation of the one or more lighting systems. Also, the module 522 may be connected to one or more electronic locks at the property and may be configured to control operation of the one or more electronic locks (e.g., control Z-Wave locks using wireless communications in the Z-Wave protocol. Further, the module 522 may be connected to one or more appliances at the property and may be configured to control operation of the one or more appliances. The module 522 may include multiple modules that are each specific to the type of device being controlled in an automated manner. The module 522 may control the one or more devices based on commands received from the control unit 510. For instance, the module 522 may cause a lighting system to illuminate an area to provide a better image of the area when captured by a camera 530.

The camera 530 may be a video/photographic camera or other type of optical sensing device configured to capture images. For instance, the camera 530 may be configured to capture images of an area within a building or within a residential facility 102-A monitored by the control unit 510. The camera 530 may be configured to capture single, static images of the area and also video images of the area in which multiple images of the area are captured at a relatively high frequency (e.g., thirty images per second). The camera 530 may be controlled based on commands received from the control unit 510.

The camera 530 may be triggered by several different types of techniques. For instance, a Passive Infra-Red (PIR) motion sensor may be built into the camera 530 and used to trigger the camera 530 to capture one or more images when motion is detected. The camera 530 also may include a microwave motion sensor built into the camera and used to trigger the camera 530 to capture one or more images when motion is detected. The camera 530 may have a "normally open" or "normally closed" digital input that can trigger capture of one or more images when external sensors (e.g., the sensors 520, PIR, door/window, etc.) detect motion or other events. In some implementations, the camera 530 receives a command to capture an image when external devices detect motion or another potential alarm event. The camera 530 may receive the command from the controller 512 or directly from one of the sensors 520.

In some examples, the camera 530 triggers integrated or external illuminators (e.g., Infra-Red, Z-wave controlled "white" lights, lights controlled by the module 522, etc.) to improve image quality when the scene is dark. An integrated or separate light sensor may be used to determine if illumination is desired and may result in increased image quality.

The camera 530 may be programmed with any combination of time/day schedules, system "arming state", or other variables to determine whether images should be captured or not when triggers occur. The camera 530 may enter a low-power mode when not capturing images. In this case, the camera 530 may wake periodically to check for inbound messages from the controller 512. The camera 530 may be powered by internal, replaceable batteries if located remotely from the control unit 510. The camera 530 may employ a small solar cell to recharge the battery when light is available. Alternatively, the camera 530 may be powered by the controller 512's power supply if the camera 530 is colocated with the controller 512.

In some implementations, the camera 530 communicates directly with the monitoring server 560 over the Internet. In these implementations, image data captured by the camera 530 does not pass through the control unit 510 and the camera 530 receives commands related to operation from the monitoring server 560.

The system 500 also includes thermostat 534 to perform dynamic environmental control at the property. The thermostat 534 is configured to monitor temperature and/or energy consumption of an HVAC system associated with the thermostat 534, and is further configured to provide control of environmental (e.g., temperature) settings. In some implementations, the thermostat 534 can additionally or alternatively receive data relating to activity at a property and/or environmental data at a property, e.g., at various locations indoors and outdoors at the property. The thermostat 534 can directly measure energy consumption of the HVAC system associated with the thermostat, or can estimate energy consumption of the HVAC system associated with the thermostat 534, for example, based on detected usage of one or more components of the HVAC system associated with the thermostat 534. The thermostat 534 can communicate temperature and/or energy monitoring information to or from the control unit 510 and can control the environmental (e.g., temperature) settings based on commands received from the control unit 510.

In some implementations, the thermostat 534 is a dynamically programmable thermostat and can be integrated with the control unit 510. For example, the dynamically programmable thermostat 534 can include the control unit 510, e.g., as an internal component to the dynamically programmable thermostat 534. In addition, the control unit 510 can be a gateway device that communicates with the dynamically programmable thermostat 534.

A module 537 is connected to one or more components of an HVAC system associated with a property, and is configured to control operation of the one or more components of the HVAC system. In some implementations, the module 537 is also configured to monitor energy consumption of the HVAC system components, for example, by directly measuring the energy consumption of the HVAC system components or by estimating the energy usage of the one or more HVAC system components based on detecting usage of components of the HVAC system. The module 537 can communicate energy monitoring information and the state of the HVAC system components to the thermostat 534 through a communication link 536 and can control the one or more components of the HVAC system based on commands received from the thermostat 534.

In some examples, the system 500 further includes one or more robotic devices 590. The robotic devices 590 may be any type of robots that are capable of moving and taking actions that assist in security monitoring. For example, the robotic devices 590 may include drones that are capable of moving throughout a property based on automated control technology and/or user input control provided by a user. In this example, the drones may be able to fly, roll, walk, or otherwise move about the property. The drones may include helicopter type devices (e.g., quad copters), rolling helicopter type devices (e.g., roller copter devices that can fly and also roll along the ground, walls, or ceiling) and land vehicle type devices (e.g., automated cars that drive around a property). In some cases, the robotic devices 590 may be robotic devices 590 that are intended for other purposes and merely associated with the system 500 for use in appropriate circumstances. For instance, a robotic vacuum cleaner device may be associated with the monitoring system 500 as one of the robotic devices 590 and may be controlled to take action responsive to monitoring system events.

In some examples, the robotic devices 590 automatically navigate within a property. In these examples, the robotic devices 590 include sensors and control processors that guide movement of the robotic devices 590 within the property. For instance, the robotic devices 590 may navigate within the property using one or more cameras, one or more proximity sensors, one or more gyroscopes, one or more accelerometers, one or more magnetometers, a global positioning system (GPS) unit, an altimeter, one or more sonar or laser sensors, and/or any other types of sensors that aid in navigation about a space. The robotic devices 590 may include control processors that process output from the various sensors and control the robotic devices 590 to move along a path that reaches the desired destination and avoids obstacles. In this regard, the control processors detect walls or other obstacles in the property and guide movement of the robotic devices 590 in a manner that avoids the walls and other obstacles.

In addition, the robotic devices 590 may store data that describes attributes of the property. For instance, the robotic devices 590 may store a floorplan and/or a three-dimensional model of the property that enables the robotic devices 590 to navigate the property. During initial configuration, the robotic devices 590 may receive the data describing attributes of the property, determine a frame of reference to the data (e.g., a home or reference location in the property), and navigate the property based on the frame of reference and the data describing attributes of the property. Further, initial configuration of the robotic devices 590 also may include learning of one or more navigation patterns in which a user provides input to control the robotic devices 590 to perform a specific navigation action (e.g., fly to an upstairs bedroom and spin around while capturing video and then return to a home charging base). In this regard, the robotic devices 590 may learn and store the navigation patterns such that the robotic devices 590 may automatically repeat the specific navigation actions upon a later request.

In some examples, the robotic devices 590 may include data capture and recording devices. In these examples, the robotic devices 590 may include one or more cameras, one or more motion sensors, one or more microphones, one or more biometric data collection tools, one or more temperature sensors, one or more humidity sensors, one or more air flow sensors, and/or any other types of sensors that may be useful in capturing monitoring data related to the property and users in the property. The one or more biometric data collection tools may be configured to collect biometric samples of a person in the home with or without contact of the person. For instance, the biometric data collection tools may include a fingerprint scanner, a hair sample collection tool, a skin cell collection tool, and/or any other tool that allows the robotic devices 590 to take and store a biometric sample that can be used to identify the person (e.g., a biometric sample with DNA that can be used for DNA testing).

In some implementations, the robotic devices 590 may include output devices. In these implementations, the robotic devices 590 may include one or more displays, one or more speakers, and/or any type of output devices that allow the robotic devices 590 to communicate information to a nearby user.

The robotic devices 590 also may include a communication module that enables the robotic devices 590 to communicate with the control unit 510, each other, and/or other devices. The communication module may be a wireless communication module that allows the robotic devices 590 to communicate wirelessly. For instance, the communication module may be a Wi-Fi module that enables the robotic devices 590 to communicate over a local wireless network at the property. The communication module further may be a 900 MHz wireless communication module that enables the robotic devices 590 to communicate directly with the control unit 510. Other types of short-range wireless communication protocols, such as Bluetooth, Bluetooth LE, Z-wave, ZigBee, etc., may be used to allow the robotic devices 590 to communicate with other devices in the property.

The robotic devices 590 further may include processor and storage capabilities. The robotic devices 590 may include any suitable processing devices that enable the robotic devices 590 to operate applications and perform the actions described throughout this disclosure. In addition, the robotic devices 590 may include solid state electronic storage that enables the robotic devices 590 to store applications, configuration data, collected sensor data, and/or any other type of information available to the robotic devices 590.

The robotic devices 590 are associated with one or more charging stations. The charging stations may be located at predefined home base or reference locations in the property. The robotic devices 590 may be configured to navigate to the charging stations after completion of tasks needed to be performed for the monitoring system 500. For instance, after completion of a monitoring operation or upon instruction by the control unit 510, the robotic devices 590 may be configured to automatically fly to and land on one of the charging stations. In this regard, the robotic devices 590 may automatically maintain a fully charged battery in a state in which the robotic devices 590 are ready for use by the monitoring system 500.

The charging stations may be contact based charging stations and/or wireless charging stations. For contact based charging stations, the robotic devices 590 may have readily accessible points of contact that the robotic devices 590 are capable of positioning and mating with a corresponding contact on the charging station. For instance, a helicopter type robotic device may have an electronic contact on a portion of its landing gear that rests on and mates with an electronic pad of a charging station when the helicopter type robotic device lands on the charging station. The electronic contact on the robotic device may include a cover that opens to expose the electronic contact when the robotic device is charging and closes to cover and insulate the electronic contact when the robotic device is in operation.

For wireless charging stations, the robotic devices 590 may charge through a wireless exchange of power. In these cases, the robotic devices 590 need only locate themselves closely enough to the wireless charging stations for the wireless exchange of power to occur. In this regard, the positioning needed to land at a predefined home base or reference location in the property may be less precise than with a contact based charging station. Based on the robotic devices 590 landing at a wireless charging station, the wireless charging station outputs a wireless signal that the robotic devices 590 receive and convert to a power signal that charges a battery maintained on the robotic devices 590.

In some implementations, each of the robotic devices 590 has a corresponding and assigned charging station such that the number of robotic devices 590 equals the number of charging stations. In these implementations, the robotic devices 590 always navigate to the specific charging station assigned to that robotic device. For instance, a first robotic device may always use a first charging station and a second robotic device may always use a second charging station.

In some examples, the robotic devices 590 may share charging stations. For instance, the robotic devices 590 may use one or more community charging stations that are capable of charging multiple robotic devices 590. The community charging station may be configured to charge multiple robotic devices 590 in parallel. The community charging station may be configured to charge multiple robotic devices 590 in serial such that the multiple robotic devices 590 take turns charging and, when fully charged, return to a predefined home base or reference location in the property that is not associated with a charger. The number of community charging stations may be less than the number of robotic devices 590.

Also, the charging stations may not be assigned to specific robotic devices 590 and may be capable of charging any of the robotic devices 590. In this regard, the robotic devices 590 may use any suitable, unoccupied charging station when not in use. For instance, when one of the robotic devices 590 has completed an operation or is in need of battery charge, the control unit 510 references a stored table of the occupancy status of each charging station and instructs the robotic device to navigate to the nearest charging station that is unoccupied.

The system 500 further includes one or more integrated security devices 580. The one or more integrated security devices 580 may include any type of device used to provide alerts based on received sensor data. For instance, the one or more control units 510 may provide one or more alerts to the one or more integrated security input/output devices. Additionally, the one or more control units 510 may receive one or more sensor data from the sensors 520 and determine whether to provide an alert to the one or more integrated security input/output devices 580.

The sensors 520, the module 522, the camera 530, the thermostat 534, and the integrated security devices 580 communicate with the controller 512 over communication links 524, 526, 528, 532, 584, and 586. The communication links 524, 526, 528, 532, 584, and 586 may be a wired or wireless data pathway configured to transmit signals from the sensors 520, the module 522, the camera 530, the thermostat 534, and the integrated security devices 580 to the controller 512. The sensors 520, the module 522, the camera 530, the thermostat 534, and the integrated security devices 580 may continuously transmit sensed values to the controller 512, periodically transmit sensed values to the controller 512, or transmit sensed values to the controller 512 in response to a change in a sensed value.

The communication links 524, 526, 528, 532, 584, and 586 may include a local network. The sensors 520, the module 522, the camera 530, the thermostat 534, and the integrated security devices 580, and the controller 512 may exchange data and commands over the local network. The local network may include 802.11 "Wi-Fi" wireless Ethernet (e.g., using low-power Wi-Fi chipsets), Z-Wave, ZigBee, Bluetooth, "Homeplug" or other "Powerline" networks that operate over AC wiring, and a Category 5 (CAT5) or Category 5 (CAT6) wired Ethernet network. The local network may be a mesh network constructed based on the devices connected to the mesh network.

The monitoring server 560 is an electronic device configured to provide monitoring services by exchanging electronic communications with the control unit 510, the one or more user devices 540 and 550, and the central alarm station server 570 over the network 505. For example, the monitoring server 560 may be configured to monitor events (e.g., alarm events) generated by the control unit 510. In this example, the monitoring server 560 may exchange electronic communications with the network module 514 included in the control unit 510 to receive information regarding events (e.g., alerts) detected by the control unit 510. The monitoring server 560 also may receive information regarding events (e.g., alerts) from the one or more user devices 540 and 550.

In some examples, the monitoring server 560 may route alert data received from the network module 514 or the one or more user devices 540 and 550 to the central alarm station server 570. For example, the monitoring server 560 may transmit the alert data to the central alarm station server 570 over the network 505.

The monitoring server 560 may store sensor and image data received from the monitoring system and perform analysis of sensor and image data received from the monitoring system. Based on the analysis, the monitoring server 560 may communicate with and control aspects of the control unit 510 or the one or more user devices 540 and 550.

The central alarm station server 570 is an electronic device configured to provide alarm monitoring service by exchanging communications with the control unit 510, the one or more user devices 540 and 550, and the monitoring server 560 over the network 505. For example, the central alarm station server 570 may be configured to monitor alerting events generated by the control unit 510. In this example, the central alarm station server 570 may exchange communications with the network module 514 included in the control unit 510 to receive information regarding alerting events detected by the control unit 510. The central alarm station server 570 also may receive information regarding alerting events from the one or more user devices 540 and 550 and/or the monitoring server 560.

The central alarm station server 570 is connected to multiple terminals 572 and 574. The terminals 572 and 574 may be used by operators to process alerting events. For example, the central alarm station server 570 may route alerting data to the terminals 572 and 574 to enable an operator to process the alerting data. The terminals 572 and 574 may include general-purpose computers (e.g., desktop personal computers, workstations, or laptop computers) that are configured to receive alerting data from a server in the central alarm station server 570 and render a display of information based on the alerting data. For instance, the controller 512 may control the network module 514 to transmit, to the central alarm station server 570, alerting data indicating that a sensor 520 detected motion from a motion sensor via the sensors 520. The central alarm station server 570 may receive the alerting data and route the alerting data to the terminal 572 for processing by an operator associated with the terminal 572. The terminal 572 may render a display to the operator that includes information associated with the alerting event (e.g., the lock sensor data, the motion sensor data, the contact sensor data, etc.) and the operator may handle the alerting event based on the displayed information.

In some implementations, the terminals 572 and 574 may be mobile devices or devices designed for a specific function. Although FIG. 5 illustrates two terminals for brevity, actual implementations may include more (and, perhaps, many more) terminals.

The one or more user devices 540 and 550 are devices that host and display user interfaces. For instance, the user device 540 is a mobile device that hosts one or more native applications (e.g., the smart home application 542). The user device 540 may be a cellular phone or a non-cellular locally networked device with a display. The user device 540 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 540 may perform functions unrelated to the monitoring system, such as placing personal telephone calls, playing music, playing video, displaying pictures, browsing the Internet, maintaining an electronic calendar, etc.

The user device 540 includes a smart home application 542. The smart home application 542 refers to a software/firmware program running on the corresponding mobile device that enables the user interface and features described throughout. The user device 540 may load or install the smart home application 542 based on data received over a network or data received from local media. The smart home application 542 runs on mobile devices platforms, such as Phone, Pod touch, Blackberry, Google Android, Windows Mobile, etc. The smart home application 542 enables the user device 540 to receive and process image and sensor data from the monitoring system.

The user device 550 may be a general-purpose computer (e.g., a desktop personal computer, a workstation, or a laptop computer) that is configured to communicate with the monitoring server 560 and/or the control unit 510 over the network 505. The user device 550 may be configured to display a smart home user interface 552 that is generated by the user device 550 or generated by the monitoring server 560. For example, the user device 550 may be configured to display a user interface (e.g., a web page) provided by the monitoring server 560 that enables a user to perceive images captured by the camera 530 and/or reports related to the monitoring system. Although FIG. 5 illustrates two user devices for brevity, actual implementations may include more (and, perhaps, many more) or fewer user devices.

In some implementations, the one or more user devices 540 and 550 communicate with and receive monitoring system data from the control unit 510 using the communication link 538. For instance, the one or more user devices 540 and 550 may communicate with the control unit 510 using various local wireless protocols such as Wi-Fi, Bluetooth, Z-wave, ZigBee, HomePlug (Ethernet over power line), or wired protocols such as Ethernet and USB, to connect the one or more user devices 540 and 550 to local security and automation equipment. The one or more user devices 540 and 550 may connect locally to the monitoring system and its sensors and other devices. The local connection may improve the speed of status and control communications because communicating through the network 505 with a remote server (e.g., the monitoring server 560) may be significantly slower.

Although the one or more user devices 540 and 550 are shown as communicating with the control unit 510, the one or more user devices 540 and 550 may communicate directly with the sensors and other devices controlled by the control unit 510. In some implementations, the one or more user devices 540 and 550 replace the control unit 510 and perform the functions of the control unit 510 for local monitoring and long range/offsite communication.

In other implementations, the one or more user devices 540 and 550 receive monitoring system data captured by the control unit 510 through the network 505. The one or more user devices 540, 550 may receive the data from the control unit 510 through the network 505 or the monitoring server 560 may relay data received from the control unit 510 to the one or more user devices 540 and 550 through the network 505. In this regard, the monitoring server 560 may facilitate communication between the one or more user devices 540 and 550 and the monitoring system.

In some implementations, the one or more user devices 540 and 550 may be configured to switch whether the one or more user devices 540 and 550 communicate with the control unit 510 directly (e.g., through link 538) or through the monitoring server 560 (e.g., through network 505) based on a location of the one or more user devices 540 and 550. For instance, when the one or more user devices 540 and 550 are located close to the control unit 510 and in range to communicate directly with the control unit 510, the one or more user devices 540 and 550 use direct communication. When the one or more user devices 540 and 550 are located far from the control unit 510 and not in range to communicate directly with the control unit 510, the one or more user devices 540 and 550 use communication through the monitoring server 560.

Although the one or more user devices 540 and 550 are shown as being connected to the network 505, in some implementations, the one or more user devices 540 and 550 are not connected to the network 505. In these implementations, the one or more user devices 540 and 550 communicate directly with one or more of the monitoring system components and no network (e.g., Internet) connection or reliance on remote servers is needed.

In some implementations, the one or more user devices 540 and 550 are used in conjunction with only local sensors and/or local devices in a house. In these implementations, the system 500 only includes the one or more user devices 540 and 550, the sensors 520, the module 522, the camera 530, and the robotic devices 590. The one or more user devices 540 and 550 receive data directly from the sensors 520, the module 522, the camera 530, and the robotic devices 590 and sends data directly to the sensors 520, the module 522, the camera 530, and the robotic devices 590. The one or more user devices 540, 550 provide the appropriate interfaces/processing to provide visual surveillance and reporting.

In other implementations, the system 500 further includes network 505 and the sensors 520, the module 522, the camera 530, the thermostat 534, and the robotic devices 590 are configured to communicate sensor and image data to the one or more user devices 540 and 550 over network 505 (e.g., the Internet, cellular network, etc.). In yet another implementation, the sensors 520, the module 522, the camera 530, the thermostat 534, and the robotic devices 590 (or a component, such as a bridge/router) are intelligent enough to change the communication pathway from a direct local pathway when the one or more user devices 540 and 550 are in close physical proximity to the sensors 520, the module 522, the camera 530, the thermostat 534, and the robotic devices 590 to a pathway over network 505 when the one or more user devices 540 and 550 are farther from the sensors 520, the module 522, the camera 530, the thermostat 534, and the robotic devices 590. In some examples, the system leverages GPS information from the one or more user devices 540 and 550 to determine whether the one or more user devices 540 and 550 are close enough to the sensors 520, the module 522, the camera 530, the thermostat 534, and the robotic devices 590 to use the direct local pathway or whether the one or more user devices 540 and 550 are far enough from the sensors 520, the module 522, the camera 530, the thermostat 534, and the robotic devices 590 that the pathway over network 505 is required. In other examples, the system leverages status communications (e.g., pinging) between the one or more user devices 540 and 550 and the sensors 520, the module 522, the camera 530, the thermostat 534, and the robotic devices 590 to determine whether communication using the direct local pathway is possible. If communication using the direct local pathway is possible, the one or more user devices 540 and 550 communicate with the sensors 520, the module 522, the camera 530, the thermostat 534, and the robotic devices 590 using the direct local pathway. If communication using the direct local pathway is not possible, the one or more user devices 540 and 550 communicate with the sensors 520, the module 522, the camera 530, the thermostat 534, and the robotic devices 590 using the pathway over network 505.

In some implementations, the system 500 provides end users with access to images captured by the camera 530 to aid in decision making. The system 500 may transmit the images captured by the camera 530 over a wireless WAN network to the user devices 540 and 550. Because transmission over a wireless WAN network may be relatively expensive, the system 500 uses several techniques to reduce costs while providing access to significant levels of useful visual information.

In some implementations, a state of the monitoring system and other events sensed by the monitoring system may be used to enable/disable video/image recording devices (e.g., the camera 530). In these implementations, the camera 530 may be set to capture images on a periodic basis when the alarm system is armed in an "Away" state, but set not to capture images when the alarm system is armed in a "Stay" state or disarmed. In addition, the camera 530 may be triggered to begin capturing images when the alarm system detects an event, such as an alarm event, a door-opening event for a door that leads to an area within a field of view of the camera 530, or motion in the area within the field of view of the camera 530. In other implementations, the camera 530 may capture images continuously, but the captured images may be stored or transmitted over a network when needed.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A method performed by one or more computers, the method comprising:

obtaining voltage measurements across at least two interface terminals i) of a thermostat that controls an HVAC system of a property ii) at least one interface terminal of which is configured to deliver power to the HVAC system;

analyzing the voltage measurements obtained across the at least two interface terminals at least one of which is configured to deliver power to the HVAC system;

in response to analyzing the voltage measurements obtained across the at least two interface terminals at least one of which is configured to deliver power to the HVAC system, determining a likely power cycling activity of a component of the HVAC system;

in response to determining the likely power cycling activity of the component of the HVAC system, determining whether the HVAC system is operating properly; and in response to determining whether the HVAC system is operating properly, generating and outputting data indicating whether the HVAC system is operating properly.

2. The method of claim 1, wherein determining the likely power cycling activity of the component of the HVAC system comprises:

identifying a voltage waveform from the voltage measurements;

identifying one or more deviations in the voltage waveform from a waveform model;

determining that the one or more deviations match one or more known voltage deviations, wherein the known voltage deviations correspond to different power cycling activities; and in response to determining that the one or more deviations match the one or more known voltage deviations, determining the likely power cycling activity as the power cycling activity that corresponds to the one or more known voltage deviations.

3. The method of claim 2, comprising obtaining the waveform model, wherein the waveform model corresponds to a signal generated by the thermostat or by the HVAC system.

4. The method of claim 3, wherein the signal indicates that one or more components of the HVAC system should be turned on or have been turned on.

5. The method of claim 3, wherein the signal indicates that one or more components of the HVAC system should be turned off or have been turned off.

6. The method of claim 2, comprising obtaining the waveform model, wherein the waveform model corresponds to one or more of the HVAC system, components of the HVAC system, models of components of the HVAC system, the component of the HVAC system, or a model of the component of the HVAC system.

7. The method of claim 2, wherein identifying the one or more deviations in the voltage waveform from the waveform model comprises determining that the voltage waveform deviates one or more of a threshold amplitude or a threshold frequency from the waveform model.

8. The method of claim 2, comprising obtaining the known voltage deviations, wherein the known voltage deviations correspond to one or more of power cycling events of components of the HVAC system, models of components of the HVAC system, the component of the HVAC system, a model of the component of the HVAC system, or electronic devices outside of the HVAC system.

9. The method of claim 2, wherein determining that the one or more deviations match the one or more known voltage deviations comprises determining that the one or more deviations are within one or more of a threshold amplitude or a threshold frequency from the one or more known voltage deviations.

10. The method of claim 1, wherein determining the likely power cycling activity of the component of the HVAC system comprises determining one or more of:

the component of the HVAC system turned off;

the component of the HVAC system turned on;

the component of the HVAC system turned off and then turned on; or the component of the HVAC system turned on and then turned off.

11. The method of claim 1, wherein:

obtaining the voltage measurements across the at least two interface terminals of the thermostat comprises obtaining, by the thermostat, the voltage measurements across the at least two interface terminals of the thermostat that are coupled to the component of the HVAC system;

analyzing the voltage measurements comprises analyzing, by the thermostat, the voltage measurements;

determining the likely power cycling activity of the component of the HVAC system comprises determining, by the thermostat, the likely power cycling activity of the component of the HVAC system;

determining whether the HVAC system is operating properly comprises determining, by the thermostat, whether the HVAC system is operating properly; and generating and outputting data indicating whether the HVAC system is operating properly comprises generating and outputting, by the thermostat, data indicating whether the HVAC system is operating properly.

12. The method of claim 1, wherein determining whether the HVAC system is operating properly comprises:

identifying an operation of the HVAC system corresponding to the voltage measurements, the operation indicating expected power cycling activities of components of the HVAC system and expected states of the components of the HVAC system; and determining that the HVAC system is operating properly if the likely power cycling activity of the component of the HVAC system is an expected power cycling activity of the expected power cycling activities, or determining that the HVAC system is operating improperly if the likely power cycling activity of the component of the HVAC system is not an expected power cycling activity of the power cycling activities.

13. The method of claim 12, comprising:

obtaining sensor data; and using the sensor data to independently verify one or more of:

that the component of the HVAC system experienced the likely power cycling activity, that a state of the component of the HVAC system matches an expected state of the component of the HVAC system in response to the operation of the HVAC system corresponding to the voltage measurements, a state of the component of the HVAC system does not match an expected state of the component of the HVAC system in response to the operation of the HVAC system corresponding to the voltage measurements, that power cycling activities experienced by the component of the HVAC system other than the likely power cycling activity match expected power cycling activities of the component of the HVAC system in response to the operation of the HVAC system corresponding to the voltage measurements, that power cycling activities experienced by the component of the HVAC system other than the likely power cycling activity do not match expected power cycling activities of the component of the HVAC system in response to the operation of the HVAC system corresponding to the voltage measurements, states of other components of the HVAC system match expected states of other components of the HVAC system in response to the operation of the HVAC system corresponding to the voltage measurements, states of other components of the HVAC system do not match expected states of other components of the HVAC system in response to the operation, that power cycling activities of other components of the HVAC system match expected power cycling activities of other components of the HVAC system in response to the operation of the HVAC system corresponding to the voltage measurements, or that power cycling activities of other components of the HVAC system do not match expected power cycling activities of other components of the HVAC system in response to the operation of the HVAC system corresponding to the voltage measurements.

14. The method of claim 1, wherein generating and outputting the data indicating whether the HVAC system is operating properly comprises:

generating information that includes one or more of an indication that the HVAC system is operating properly, an indication that the HVAC system is operating improperly, indications of unexpected power cycling activities, indications of components of the HVAC system that experienced unexpected power cycling activities, indications of unexpected states of components of the HVAC system, or indications of components of the HVAC system that have an unexpected state; and providing the information to a device.

15. The method of claim 1, wherein:

analyzing the voltage measurements comprises:

determining whether the voltage measurements satisfy one or more voltage thresholds; and determining the likely power cycling activity uses a voltage threshold, from the one or more voltage thresholds, that is satisfied by the voltage measurements.

16. The method of claim 15, wherein the likely power cycling activity is a turn-on event of a component of the HVAC system or of an appliance of the property.

17. The method of claim 15, wherein the likely power cycling activity is a turn-off event of a component of the HVAC system or of an appliance of the property.

18. The method of claim 15, wherein determining the likely power cycling activity of the component of the HVAC system comprises:

identifying a state of the thermostat;

in response to identifying the state, identifying one or more commands sent by the thermostat to the HVAC system, wherein each of the one or more commands is associated with a power cycling activity and a component of the HVAC system;

determining one or more time periods corresponding to the one or more commands;

determining that the likely power cycling activity occurs during a time period of the one or more time periods; and associating the likely power cycling activity with the component of the HVAC system that corresponds to the time period.

19. A system comprising:

one or more computers; and one or more computer-readable media storing instructions that, when executed, cause the one or more computers to perform operations comprising:

obtaining voltage measurements across at least two interface terminals i) of a thermostat that controls an HVAC system of a property ii) at least one interface terminal of which is configured to deliver power to the HVAC system;

analyzing the voltage measurements obtained across the at least two interface terminals at least one of which is configured to deliver power to the HVAC system;

in response to analyzing the voltage measurements obtained across the at least two interface terminals at least one of which is configured to deliver power to the HVAC system, determining a likely power cycling activity of a component of the HVAC system;

in response to the likely power cycling activity of the component of the HVAC system, determining whether the HVAC system is operating properly; and in response to determining whether the HVAC system is operating properly, generating and outputting data indicating whether the HVAC system is operating properly.

20. One or more non-transitory computer-readable media storing instructions that, when executed by one or more computers, cause the one or more computers to perform operations comprising:

obtaining voltage measurements across at least two interface terminals i) of a thermostat that controls an HVAC system of a property ii) at least one interface terminal of which is configured to deliver power to the HVAC system;

analyzing the voltage measurements obtained across the at least two interface terminals at least one of which is configured to deliver power to the HVAC system;

in response to analyzing the voltage measurements obtained across the at least two interface terminals at least one of which is configured to deliver power to the HVAC system, determining a likely power cycling activity of a component of the HVAC system;

in response to the likely power cycling activity of the component of the HVAC system, determining whether the HVAC system is operating properly; and in response to determining whether the HVAC system is operating properly, generating and outputting data indicating whether the HVAC system is operating properly.

* * * * *